US005860491A

United States Patent [19]

Fletcher

[11] Patent Number: 5,860,491

[45] Date of Patent: Jan. 19, 1999

[54] HYDRAULIC LIFT SYSTEM AND METHOD FOR RETROFITTING

[75] Inventor: Robert H. Fletcher, San Diego, Calif.

[73] Assignee: Advantage Lift Systems, Inc., San Diego, Calif.

[21] Appl. No.: 847,822

[22] Filed: Apr. 28, 1997

Related U.S. Application Data

[63] Continuation-in-part of Ser. No. 683,305, Jul. 18, 1996, Pat. No. 5,740,886.

[51] Int. Cl.[6] ..... B66F 7/00

[52] U.S. Cl. ..... 187/203; 187/272; 254/89 H

[58] Field of Search ..... 187/203, 205, 187/210, 216, 272, 275; 254/936, 92, 89 H, 93 R

[56] References Cited

U.S. PATENT DOCUMENTS

| | | | |
|---|---|---|---|
| D. 343,488 | 1/1994 | Fletcher | D34/28 |
| 1,870,128 | 8/1932 | Lunati | 187/215 |
| 1,889,185 | 11/1932 | Stukenborg | 187/215 |
| 1,898,534 | 2/1933 | Steedman | 254/93 L |
| 1,915,024 | 6/1933 | Logette et al. | 91/402 |
| 3,061,044 | 10/1962 | Shotmeyer | 187/215 |
| 3,892,292 | 7/1975 | Takenoshita et al. | 187/17 |
| 4,022,428 | 5/1977 | Mantha | 254/89 R |

(List continued on next page.)

FOREIGN PATENT DOCUMENTS 9631292 10/1996 WIPO .

OTHER PUBLICATIONS

Benwill Grand Prix Automotive Lift Systems, Benwill Industries Inc. (Mar. 1996).

JAB Brochure—2–Bis 4–Stempel–Hebebuhnen, J.A. Becker & Sohne, Maschinenfabrik, Postfach 1151, 74148 Neckarsulm, Tel. 07132–3670, Fax 07132, 36787, pp. 1–15 (1995).

Gibraltar Auto Lifts, Tulsa, OK, 1–800–364–5438 (1995).

MonoRam MP & LP Lifts, J.A. Becker & Sohne, P.O. Box 1151, D–74148 Neckarsulm, Phone: + 49 (0) 7132/3 67–0, Fax: + 49 (0) 7132/3 67 89, Telex: 728 863 (1995).

TwinRam, J.A. Becker & Sohne, Postfach 1151, D–74148 Neckarsulm, Phone: + 49 (0) 7132/3 67–0, Fax: + 49 (0) 7132/3 67 89, Telex: 728 863 (1995).

(List continued on next page.)

*Primary Examiner*—Kenneth Noland
*Attorney, Agent, or Firm*—Brown, Martin, Haller & McClain, LLP

[57] ABSTRACT

A high pressure, low volume hydraulic lift system and a method for retrofitting a low pressure high volume lift system are provided. The lift system includes a low pressure high volume (LPHV) casing within which is mounted a high pressure ram. The ram is equipped to move a plunger in an axial direction with respect to the casing, without the need for any further reinforcement of the existing casing. The method for retrofitting is effected by removing the pre-existing structure of the LPHV system, cutting a hole in the upper portion of the pre-existing casing, and draining all hydraulic fluid. Thereafter, the pre-existing gland flange and plunger are removed. A high pressure low volume hydraulic cylinder and associated hydraulic line, are then installed in the casing of the pre-existing system. The bottom of the high pressure hydraulic cylinder is mechanically locked to the base of the pre-existing outer casing. The hydraulic line is attached to a new hydraulic compressor and a new plunger is added to the new hydraulic cylinder and, with it, an appropriate bearing and guide mechanism that uses the pre-existing casing as an outer guide means for the new plunger. Once the hydraulic ram is installed, any holes cut in the slab are filled with concrete. The lift system and method may be adapted for any type of pre-existing LPHV, such as that used in the automotive industry or in elevators. When used in connection with an automotive lift, the pre-existing superstructure is then secured to the top of the new plunger and cylinder structure.

47 Claims, 20 Drawing Sheets

U.S. PATENT DOCUMENTS

| | | | |
|---|---|---|---|
| 4,687,078 | 8/1987 | Wilson | 187/17 |
| 4,700,748 | 10/1987 | Fossati et al. | 137/877 |
| 4,726,450 | 2/1988 | Fossati et al. | 187/111 |
| 4,763,761 | 8/1988 | McKinsey et al. | 187/8.41 |
| 4,830,146 | 5/1989 | Nakamura et al. | 187/26 |
| 4,830,147 | 5/1989 | Kawada | 187/8.62 |
| 4,848,732 | 7/1989 | Rossato | 254/90 |
| 5,014,824 | 5/1991 | Fargo | 187/17 |
| 5,050,844 | 9/1991 | Hawk | 254/89 |
| 5,096,159 | 3/1992 | Fletcher | 254/90 |
| 5,099,956 | 3/1992 | Curran | 187/8.41 |
| 5,190,122 | 3/1993 | Fletcher et al. | 187/8.5 |
| 5,199,686 | 4/1993 | Fletcher | 254/90 |
| 5,259,482 | 11/1993 | Proulx et al. | 187/8.62 |
| 5,299,658 | 4/1994 | Cox et al. | 187/8.41 |
| 5,322,143 | 6/1994 | Curran | 187/8.49 |
| 5,404,968 | 4/1995 | Fletcher | 187/205 |
| 5,501,296 | 3/1996 | Fletcher | 187/210 |
| 5,518,220 | 5/1996 | Bertrand et al. | 254/7 B |
| 5,573,083 | 11/1996 | Fletcher et al. | 187/205 |
| 5,709,286 | 1/1998 | Mead et al. | 187/205 |

OTHER PUBLICATIONS

Stenhoj All–Purpose Lift, Stenhoj, DK–7150 Barrit, Phone: + 45 75 691222, telex: 60644 stnhj, telefax + 45 75 691035 (1995).

Slift Car Lifts, SLIFT Frank E. Sommerer (1995).

NUSBAUM brochure—Top–Lift, NUSBAUM Hebetechnik, Otto NUSBAUM GmbH & Co., KG, 77694 Kehl–Bodersweier (1995).

Drawing, J.A. Becker & Soehne, Maschinefabrik, 74148 Neckarsulm.

Drawing, Challenger Lifts, 1402 West Main, Louisville, KY 40201.

Drawing (German language), Aie Anbindung des Rehmans en die, Bodenplatte kann nur durcl en orlichen, Architekten/Slatiker beurleilt werden.

HYDRAULIC LIFT SYSTEM AND METHOD FOR RETROFITTING

This application is a continuation-in-part of U.S. application Ser. No. 08/683,305 entitled METHOD OF RETROFIT OF IN-GROUND AUTOMOTIVE LIFTS to Robert Fletcher, filed on Jul. 18, 1996 now U.S. Pat. No. 5,740,886. The subject matter of U.S. application Ser. No. 08/683,305 is herein incorporated in its entirety by reference thereto.

FIELD OF THE INVENTION

The present invention relates to in-ground hydraulic lifts and methods therefor. More particularly a method of retrofitting low pressure high volume (LPHV) hydraulic lift systems to construct a high pressure low volume (HPLV) hydraulic lift system and the resulting lift system are provided.

BACKGROUND OF THE INVENTION

In a typical in-ground hydraulic lift system, commonly known as a LPHV lift system, forty to sixty gallons of hydraulic fluid, at a pressure of 100 to 125 p.s.i. are required to raise a car, and 120 to 150 gallons of hydraulic fluid at a pressure of 100 to 350 p.s.i., are required to raise a truck or bus. In recent years, it has been recognized that the use of such large quantities of hydraulic fluid can often give rise to environmental concerns.

Such environmental concerns are due to the commonplace occurrence of hydraulic fluid leaks from most LPHV lift systems. More particularly, hydraulic fluid, while for the most part comprising an oil-based hydrocarbon carbohydrate, can include certain caustic and heavy metal additives including iron, lead, copper, tin, aluminum, nickel, phosphorous, molybdenum and cadmium. These additives, if permitted to penetrate the water table, can contaminate the water supply at concentrations, which, while only a few parts per billion, can accumulate to approach levels that are teratogenic, carcinogenic, or otherwise toxic to humans and/or wildlife. There is, therefore, a burgeoning awareness by environmental officials and others that the in-ground hydraulic lift, which has been a standard in service stations throughout the world since the 1920's, presents an actual and/or potential health hazard of still unmeasured magnitude. This problem is exacerbated in areas where the water table is very high, such as in coastal areas of Florida, Georgia and Louisiana where the water table can be as high as three feet below ground level. Thus, the typical in-ground hydraulic lift, which is installed to a depth of about nine feet in the ground, presents a particularly serious hazard in such areas.

In an effort to minimize the volume of fluid used in the LPHV lift systems, a lift having a slightly higher hydraulic pressure has been developed. Typically, this lift system operates with a pressure of approximately 600 psi, and requires approximately 10 gallons to lift a vehicle. Such an intermediate lift system, however, still requires a significant quantity of fluid, and can still present a threat to the environment. Moreover, because of the quantity of hydraulic fluid needed to lift a vehicle, in combination with the higher pressures being used, it may be difficult to provide the necessary containment precautions to prevent the leakage of hydraulic fluid in the event the lift is damaged.

Another solution, which has been proposed to overcome the problem of the leakage of hydraulic fluid into the ground and water table, has been to further minimizing the volume of hydraulic fluid used in lift systems such that the containment problem becomes easier to address. Associated with such a reduction in volume of hydraulic fluid is an increase in the fluid pressure which must be applied to the hydraulic fluid. In a typical HPLV lift system, a volume of 2.5 gallons of hydraulic fluid, at a pressure of approximately 2,500 psi, can raise a car. Six gallons of hydraulic fluid at the same pressure can raise a truck or bus. Accordingly, it may be seen that in applications such as the lifting of a bus, truck or other heavy duty vehicles, the quantity of fluid required can be reduced to about three percent of that required in a traditional LPHV system.

HPLV systems are known in the art and are commercially offered, for example, by Nusbaum of Germany, Stenhoj of Sweden, and Rotary in the United States. These systems, for the most part, require a service station to excavate the massive concrete and steel structure associated with traditional LPHV systems and replace the low pressure system with a high pressure system. Such excavation is generally quite costly, and may involve the removal of a considerable amount of contaminated soil caused by the previous leaky LPHV system. Therefore, as a practical matter, the use of high pressure lift systems is cost-effective only for new service stations or new auto repair facilities.

In addition to the significant excavation and removal of contamination, the installation of a new HPLV lift system requires that the superstructure, the portion of the lift that is mounted on the upper surface of the plunger and physically engages the vehicle being lifted, must be replaced. This is so because high pressure lifts include a hydraulic ram, or cylinder, which has a smaller diameter than the old low volume plunger, which prevents reuse of the superstructure. As a result, the replacement of low pressure lifts with the more efficient high pressure lifts is often prohibitively expensive.

In addition to the attempt to use HPLV lift systems, a containment device, such as an oversized plastic encapsulation, has been developed for the enclosure and protection of the hydraulics of a lift system. Such a system is offered for sale by Benwil Automotive, and requires the excavation of the old LPHV system in order to install the fluid containment device. Thus, if the existing lift system has caused any amount of environmental contamination, installation of a Benwil Automotive lift would still require the clean-up of the contamination, often at a considerable expense.

Thus, the problem has not been adequately solved and a viable and affordable method for converting LPHV lift systems to HPLV lift systems is needed. Therefore, it is an object herein to provide a method by which LPHV hydraulic lift systems may be cost-effectively replaced by HPLV lift systems. It is also an object herein to provide a method for retrofitting that makes effective use of components of the pre-existing LPHV lift systems by providing a method for retrofitting LPHV hydraulic lift systems which eliminates the need to completely excavate the low pressure systems being replaced.

SUMMARY OF THE INVENTION

As a response to this recognized need, a retrofit HPLV lift system and method for conversion of LPHV lift systems to HPLV lift systems is provided herein. The retrofitted system, as well as the method provided herein, is environmentally sound, cost effective, minimizes shop disruption, does not expose existing soil, operates better than existing lifts, is easier to repair, easier to maintain, and significantly longer lasting.

The retrofit method provided herein reduces disruption to the service station work area during the retrofitting process, and eliminates the exposure of contamination caused by leaking LPHV lift systems, thereby avoiding the need for the property owner to clean up any environmental contamination. The retrofit method provided herein is readily adapted for use with a large variety of LPHV lift systems that have been manufactured and installed throughout the world over the past fifty years.

In particular, a method for retrofitting a pre-existing in-ground LPHV lift system with a new, HPLV lift system is provided. The resulting HPLV retrofitted system is also provided. The system includes a high pressure hydraulic cylinder or container, also referred to herein as a ram, positioned within the original LPHV casing, typically from a previously existing LPHV lift system, and attached to the base of the casing. The method may be used to retrofit any LPHV, such as those used in automotive lift systems and elevators.

When the LPHV is used in a garage for lifting automobiles and trucks, the original LPHV casing extends downward from the floor of the garage. The superstructure, i.e., the portion of the lift that is mounted on the upper surface of the plunger and physically engages the vehicle being lifted, is attached to upper end of the ram (the high pressure hydraulic container, typically a cylinder), whereby pressurization of the ram causes the superstructure to raise the vehicle.

The HPLV system provided herein is designed for placement within a first casing of a pre-existing low pressure, high volume hydraulic lift, which casing has an enclosed base portion disposed on a support pad. The HPLV system includes: a second casing with a closed lower end disposed in the first casing such that the closed lower end abuts an interior surface of the enclosed base portion of the first casing; a plunger that closely fits within the second casing; at least one hydraulic seal between the plunger and the second casing for retaining hydraulic fluid under high pressure within the second casing; a fluid supply line having for delivering fluid to the second casing; and a compressor for pumping the hydraulic fluid from a fluid source through the fluid supply line into the closed lower end of the second casing.

The system can also include attachment means for fixedly attaching the closed lower end of second casing to the base portion of the first casing. In preferred embodiments, the second casing is substantially cylindrical with a second diameter smaller than the first diameter, has an open upper end, a closed lower end, a second axis, and a second volume less that the first volume. The second casing is disposed within the first casing whereby a space is defined between an exterior sidewall of the second casing and an interior sidewall of the first casing, and the closed lower end abuts an interior surface of the enclosed base portion of the first casing; the plunger has an outer diameter that closely fits within the second casing, an upper end and a lower end, and is disposed within the second casing for movement therein; at least one hydraulic seal between the plunger and the second casing for retaining a hydraulic fluid under high pressure with the second casing; the fluid supply line has a first end in a first section and a second end in a second section, the first end is attached to a connector near the closed lower end of the second casing, the first section of the fluid supply line is disposed within the space between the second casing and the first casing, and the second section of the fluid supply line exits the first casing; and the compressor and the fluid source are connected to the second end of the fluid supply line exterior to the first casing.

In one particular embodiment described herein, a plunger sleeve, attached to an upper end of the plunger for axial movement therewith and having a substantially cylindrical shape with an outer diameter adapted to slidably fit within the inner diameter of the first casing, extends downwards into the casing to trap the high pressure hydraulic cylinder between the plunger sleeve and the bottom of the casing, such that when the high pressure cylinder is extended, the plunger sleeve extends vertically upwards from the casing and the floor. At least one bearing is positioned between the plunger sleeve and the casing such that the plunger sleeve will only move vertically, thereby eliminating any horizontal movement of the plunger sleeve. Actuation of the high pressure cylinder is controlled by a hydraulic compressor, which is mounted near the lift and attached via a hydraulic hose. The vertical extension of the high pressure cylinder and plunger sleeve are controlled by selective activation of the hydraulic compressor.

In certain embodiments, the HPLV system is incorporated into a vehicle lift system that is equipped with a vehicle-engaging superstructure. Preferably, this superstructure is the same superstructure that was used in conjunction with the LPHV lift being retrofitted, thereby minimizing the need for purchasing additional hardware. It is also advantageous to use the plunger from the LPHV lift being retrofitted to further minimize the cost of retrofitting the lift system.

In an alternative embodiment, the HPLV system is incorporated into a hydraulic elevator lift system, such as those used for the lifting of persons or supplies. In such an application, the HPLV lift system attaches directly to the lower portion or other suitable portion of the elevator car. Vertical movement of the elevator car is controlled by interfacing the hydraulic compressor of the HPLV lift system to the directional controls of the elevator control system. Because elevators typically operate within an elevator shaft, the elevator car experiences little horizontal movement. This allows for the high pressure cylinder to be attached directly to the bottom of the elevator car, instead of using an outer plunger otherwise incorporated to help stabilize the lift system.

A method for retrofitting is also provided. This method involves draining the high volume system until all hydraulic fluid is evacuated and, in the case of automotive lifts, the pre-existing superstructure of the LPHV lift system is removed. The concrete floor, or slab, is partially excavated in an area adjacent to the upper portion of the pre-existing lift casing. The existing gland flange and plunger are removed and a hole is drilled through the upper portion of the existing lift casing, accessible via the excavated area of the slab, to allow connection of the new hydraulic line for the high pressure hydraulic cylinder. A self-contained HPLV hydraulic cylinder and associated hydraulic line are positioned axially within the original casing of the low pressure system and the new hydraulic line is passed through the hole previously drilled in the existing lift casing. The bottom of the high pressure hydraulic cylinder is then mechanically locked to a mounting plate positioned on the base of the pre-existing outer casing to maintain the cylinder in the center of the casing and to prevent the rotation of the cylinder and to support the resulting lift and superstructure.

A new plunger, or the plunger from the original low pressure lift, is added to the new hydraulic cylinder and, with it, an appropriate bearing and guide mechanism which uses the pre-existing casing as an outer bearing guide for the lower portion of the new plunger. A liner material may be added to the existing lift casing to create a smooth surface on which the lower bearing of the new plunger may ride. A bearing housing is then mounted to the pre-existing gland flange which is then replaced upon the existing casing. Alternatively, a new gland flange may be equipped with both an upper and lower bearing. A new hydraulic compressor, or power unit, is then installed and connected to the new hydraulic line through a suitable containment raceway positioned below the concrete floor and exiting the concrete floor in the vicinity of the new compressor. Once the plunger has been replaced, the partial excavation of the concrete floor is filled with newly placed concrete. A breather element is then installed at the inlet point of the pre-existing hydraulic supply system to allow for the varying air volume within the casing and plunger. Alternatively, a new breather system may be installed attaching to the lift casing at the oil inlet port and exiting the concrete floor at any convenient point within the shop area. The pre-existing superstructure is then secured to the top of the new plunger and cylinder structure.

BRIEF DESCRIPTION OF THE DRAWINGS

Understanding of the subject matter herein will be facilitated by consideration of the following detailed description of the preferred embodiments and the accompanying drawings, in which like numerals refer to like parts, and in which.

DETAILED DESCRIPTION OF PREFERRED EMBODIMENTS

Definitions

Unless defined otherwise, all technical and scientific terms used herein have the same meaning as is commonly understood by one of skill in the art to which this invention belongs. All patents and publications referred to herein are, unless noted otherwise, incorporated by reference in their entirety. In the event a definition in this section is not consistent with definitions elsewhere, the definition set forth in this section will control.

As used herein, a low pressure high volume (LPHV) lift system, refers to systems (see, e.g, FIG. 1) in which typically about forty to sixty gallons of hydraulic fluid, at a pressure of 100 to 125 p.s.i. are used to raise a car, and 120 to 150 gallons of hydraulic fluid at a pressure of 100 to 350 p.s.i., are used to raise a truck or bus. Preferably the systems provided herein operate with 97% less fluid than the LPHV systems.

As used herein, a high pressure low volume (HPLV) hydraulic lift system refers to a system in which substantially less volume, typically about 2 to about 6 gallons of fluid is used under high pressure (about 2,500 psi) are used.

As used herein, a volume of hydraulic fluid in an HPLV system provided herein that is substantially less the volume used in an LPHV is roughly less than about 10% that of the LPHV system. For example, typical LPHV systems require forty to sixty gallons of hydraulic fluid, at a pressure 100 to 125 p.s.i. to raise a car, and 120 to 150 gallons of hydraulic fluid at a pressure of 100 to 350 p.s.i. to raise a truck or bus. An HPLV lift system, will require a volume of about 2.5–3 gallons of hydraulic fluid, at a pressure of approximately 2,500 psi, to raise a car. Six gallons of hydraulic fluid at the same pressure can raise a truck or bus.

The LPHV system for retrofitting

The methods herein are designed to retrofit existing LPHV systems to produce the HPLV system provided herein. A typical LPHV system for retrofitting is exemplified in FIG. 1. The methods and system are described with reference to an automotive lift, but it understood that these methods and resulting lift may be adapted to retrofit any LPHV system.

Figure 1:
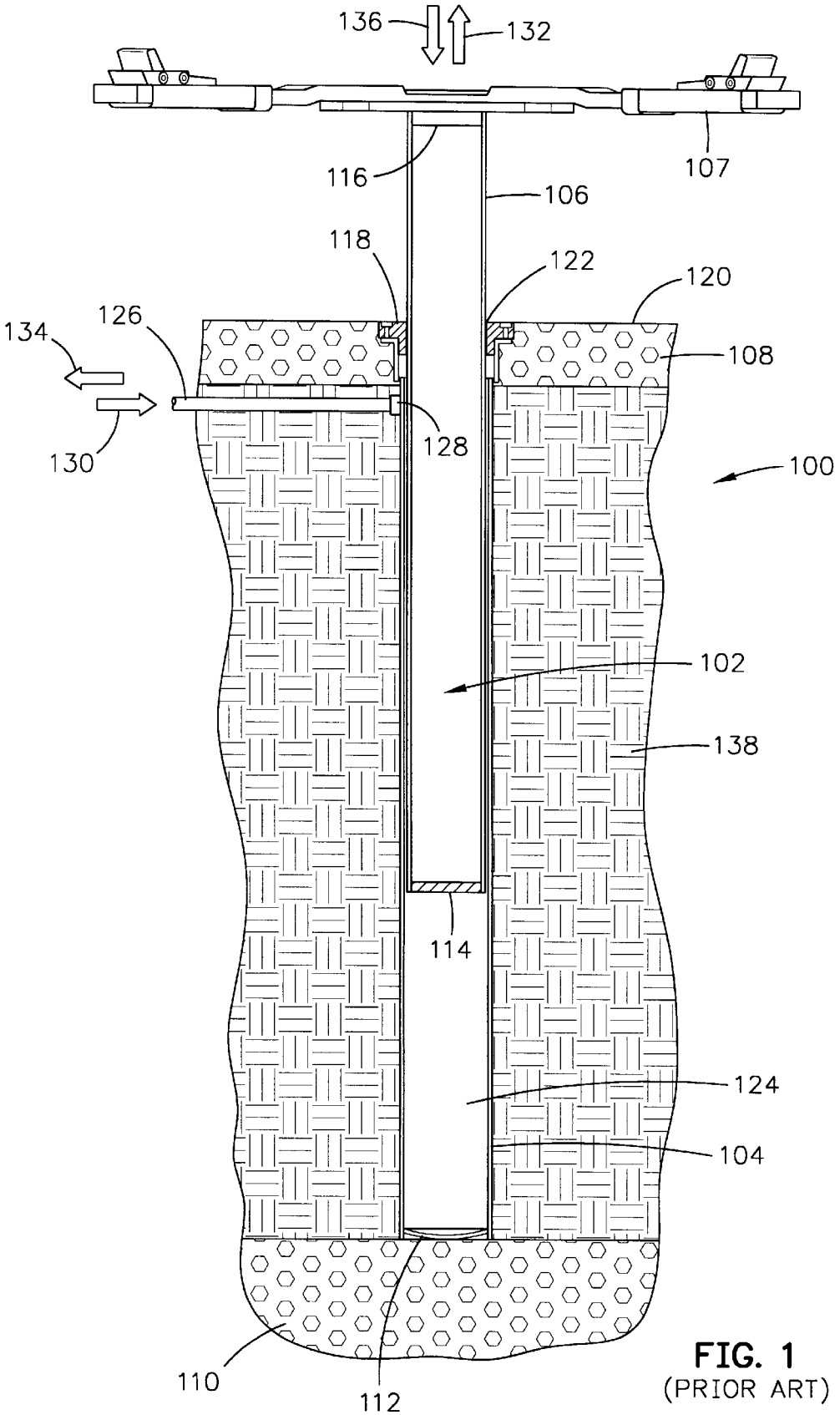
FIG. 1 (PRIOR ART)
FIG. 1 is a vertical cross-sectional view showing an in-ground LPHV automotive lift system.

Referring initially to FIG. 1, a typical LPHV automotive lift system is shown and generally designated 100. Lift 100 includes a hydraulic ram 102 which consists of a casing 104 within which a plunger 106 slides vertically. Casing 104 extends downwards from slab 108 and is substantially supported by support pad 110. Casing base 112 is firmly attached to the support pad 110 such that any load which is moved by the hydraulic ram 102 will be transferred to the pad. As a result, the pad 110 can have considerable size and may be constructed of concrete, steel, or any other material which would be capable of supporting significant weights, while at the same time exhibiting minimal deterioration when exposed to the soil.

Plunger 106 may be equipped at its lower end with a sealing plate to minimize the amount of fluid required to pressurize the hydraulic ram. The upper end of plunger 106 is equipped with a mounting plate 116 which is designed to receive superstructure 107. Superstructure 107 may be of a variety of shapes and designs, however, the intended function of the superstructure in an automotive lift is to provide the ability to physically engage the frames of a variety of vehicle types. As a result, the superstructures are typically made of a heavy gauge steel, and have moving parts in order to accommodate various vehicle widths and lengths.

At the upper end of the casing, a gland flange 118 is located and sits flush with the surface of the garage floor 120 and includes at least one hydraulic seal 122 which is intended to prevent any hydraulic fluid within the casing 104 from escaping between the gland flange 118 and the plunger 106. Any damage or deterioration to the outer surface of the plunger 106 will result in a compromise of the integrity of the seal 122, allowing hydraulic fluid 123 to escape from the LPHV lift system. This condition is worsened by the tendency of mechanics using the lift systems to be careless when working in the vicinity of the plunger, and even intentionally striking the plunger when frustrated.

When the seal 122 is compromised, the operation of the LPHV lift system is hampered. More specifically, when the outer surface of the plunger 106 is damaged, the seal 122 is unable to prevent the flow of hydraulic fluid 123 from the pressurized region 124 past the seal 122, and out onto the garage floor 120. This hydraulic fluid leak not only provides a dangerous source of environmental contamination, but also fails to hold the vehicle reliably at a particular height. In fact, the more damage inflicted on the plunger, the more the hydraulic fluid 123 will seep through the seal 122, and the more the vehicle (not shown) upon the superstructure 107 will slowly drop back to the floor. As a result, damaged plungers provide not only environmental hazards, but safety hazards for those working under and around such leaky lifts.

Figure 2:
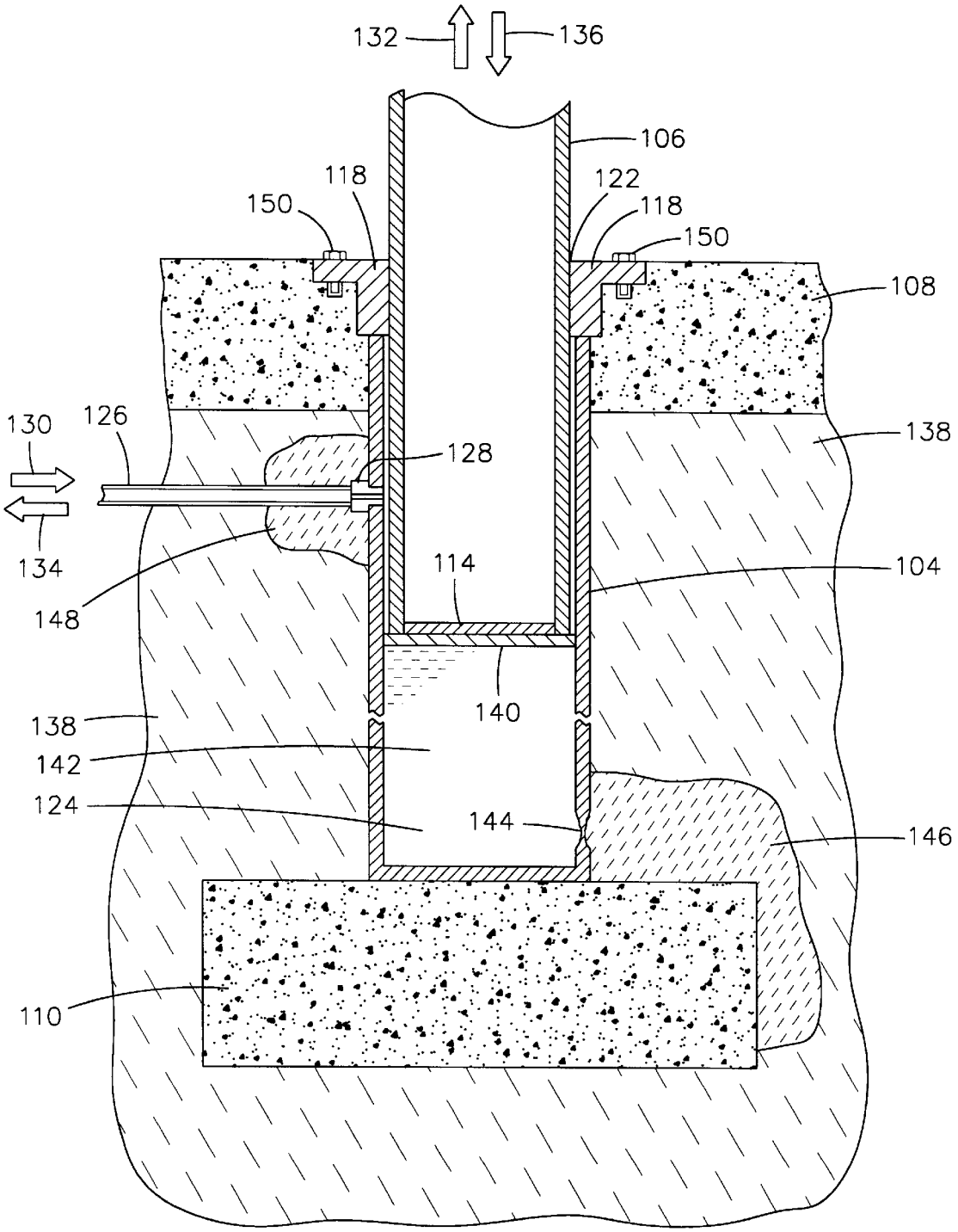
FIG. 2 (PRIOR ART)
FIG. 2 is an enlarged cross-sectional view of the lift system of FIG. 1, more clearly showing the sources of environmental contamination, and the various components of the LPHV lift system.

Referring now to FIG. 2, the lift system 100 of FIG. 1 is shown in more detail. Low pressure supply line 126 is shown attached to casing 104 with fitting 128. Operation of the LPHV lift system 100 is controlled by the direction of the flow of hydraulic fluid into the pressurized region 124. For example, when hydraulic fluid is forced in direction 130 into the pressurized region 124, the plunger is forced upwards in direction 132. Oppositely, when hydraulic fluid is bled, or released in direction 134 from the pressurized region 124, the plunger moves downwards in direction 136.

Because the entire weight of the vehicle raised by the super-structure 107 is supported by the plunger 106, the integrity of seal 122 is critical. In an attempt to improve the seal between the pressurized region and the environment, a secondary seal 140 may be provided on the lower end of the plunger. It should be appreciated that the location of low pressure supply line 126 and fitting 128 would have to be at a lower location than shown in FIG. 2, where the fitting 128 would be lower than the plunger would rest in its downward position. This is so to provide a hydraulic fluid entry location which would always be within the pressurized region, as well as preventing any damage to occur to the seal 140 due to passing by fitting 128. In such an application, however, the plunger 106 will not be bathed in hydraulic fluid, resulting in the corrosion of the outer surface of the plunger. In order to minimize such corrosion, the plunger is often coated with a corrosion resistant material, or otherwise lubricated.

Slab 108, in a typical installation, is supported by a soil encasement 138. This soil is where most environmental contamination caused by leaking lift systems occurs. For example, casing 104 may be damaged or deteriorated from soil corrosion, and allow hydraulic fluid to leak into the soil, causing contaminated soil area 146. Similarly, fitting 128 can become loose or damaged allowing hydraulic fluid to leak into the soil causing contaminated soil area 148. Leakage of hydraulic fluid from the damaged areas of the casing, or the fittings, is increased because those areas are under pressure. Moreover, a typical response in the industry when faced with a leaking lift system has been to add more hydraulic fluid. Thus, these contamination areas, in the event of a prolonged period of leakage, can be quite extensive, and in severe cases can decrease the ability of the soil 140 to support the pad 110 and slab 108.

Method of retrofitting

While the particular embodiments described herein are discussed within the context of particular LPHV lift systems, it should be noted that installation and retrofitting of any LPHV lift system is contemplated. For example, some LPHV lift systems are installed in environments where the casing is suspended downwards from a garage floor, such as where the lift is located on the second floor of a garage. In such an application, retrofitting of the lift system is substantially similar to the installations exemplified herein.

A method of retrofitting LPHV systems to produce a HPLV system is provided. For exemplification the method is described with reference to automotive lifts. The method herein involves the steps of: (a) removing, hydraulic fluid, plunger and guide means of the pre-existing system; (b) installing a self-contained or sealed high pressure, low volume hydraulic container and associated hydraulic lines within the casing of the preexisting system and abutting the bottom of the casing of the preexisting system; (c) installing a power unit for the high pressure, low volume hydraulic cylinder; and (d) installing a plunger (or using the original plunger) associated with the high pressure low volume cylinder using the casing as an outer guide means for the plunger. When automotive lifts are retrofitted, the superstructure is typically removed prior to installation of the HPLV.

Figure 22:
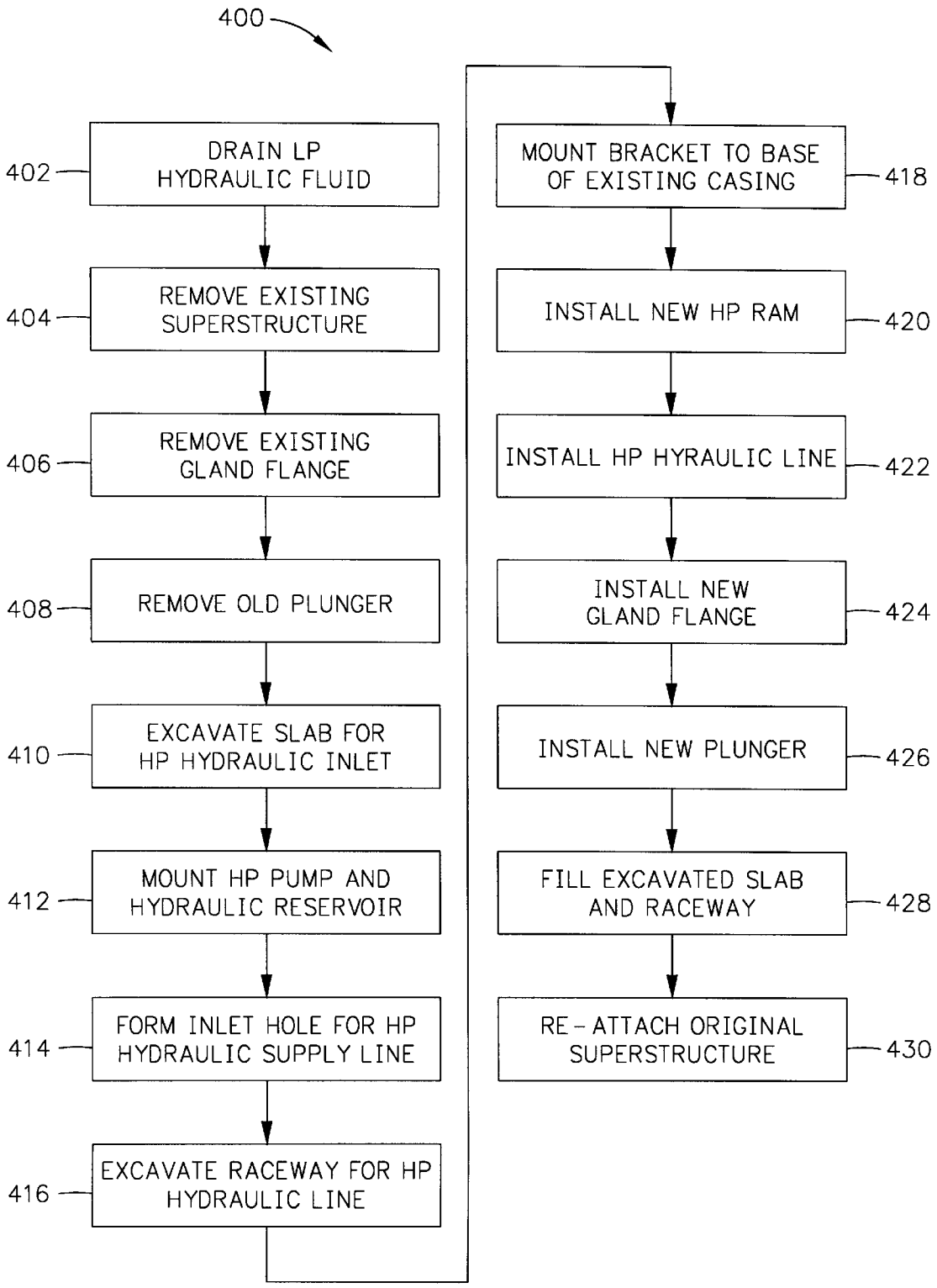
FIG. 22 is a flow chart detailing the method for retrofitting a LPHV lift system to a HPLV system.

Referring to FIG. 22, a flow chart detailing the method for retrofitting a LPHV lift system with a HPLV lift system is shown and generally designated 400. Flow chart 400 begins with first step 402 wherein prior to the disassembly of the LPHV system, all hydraulic fluid which is accessible is drained. This prevents the accidental spillage of any hydraulic fluid, as well as provides for a cleaner work environment during the retrofit process.

In next step 404, the superstructure is removed from the plunger of the LPHV lift system and is retained for future use. As discussed above, the superstructure represents a significant capital investment for the service station owner and, as a result, there is a great deal of financial economy if the superstructure can be re-used because superstructures are made so solidly that they seldom wear out, and can be used for the life of the service station.

One the superstructure is removed from the plunger, the existing gland flange is removed in step 406 and slid upwards over the end of the plunger. After removal, the gland flange may be saved for future use or may be discarded if a new bearing-equipped flange is to be used.

Next step 408 includes removing the original plunger from the casing. After removal of the plunger, a portion of the slab adjacent to the casing is excavated in step 410 to provide an entry point for the high pressure hydraulic supply line. This excavation is only minimal, and importantly does not involve the exposure of any contaminated soil. This aspect of the retrofit procedure is of a particular importance, and provides one of the more significant cost savings for the HPLV retrofit since, by excavating only a portion of the slab making certain not to expose any contaminated soil, the owner of the service station may avoid the expenses associated with the cleanup of such environmental contamination.

Step 412 includes the mounting of the high pressure hydraulic compressor and reservoir within the garage area, preferably in an area where the user may operate the lift system without being endangered by the moving vehicles on the lift. Once the compressor has been located, in step 414 a small inlet hole is formed in the side of the casing in the excavated area adjacent to the casing. This will serve as the entry point into the casing for the high pressure supply line. Following the formation of the inlet hole, a raceway is excavated in step 416 across the slab to provide a channel between the inlet hole and the compressor for the routing of the high pressure hydraulic supply line.

In step 418, a mounting bracket is attached to the base of the casing which will serve as the attachment location for the high pressure ram, which is installed in next step 420. Such an installation can prove difficult, particularly when there is a requirement to mount the ram to the mounting plate at the bottom of the casing, which is typically about 9 feet deep, and having a diameter of less than 12 inches. Moreover, when retrofitting an air-over-oil lift system, it is necessary to cut air inlet tube 276 in location 278 such that the air tube will not interfere with the placement and operation of the high pressure ram. Special tools are used which facilitate such mounting and cutting. Specifically, such tools include traditional hand tools which have been equipped with elongated handles.

In next step 422, a hydraulic supply line is attached to the hydraulic ram and passed through the inlet hole in the casing and through the raceways formed in the slab, for attachment to the hydraulic compressor. Once the hydraulic supply line is attached to the ram and the compressor, a new gland flange is installed to the top of the casing, and may be equipped with a number of bearing surfaces. Following the installation of the new gland flange, a new plunger sleeve, or perhaps the existing plunger from the LPHV lift system, is installed through the flange in step 426. Depending on the bearing structures and locations, it may be necessary to install the plunger prior to the mounting of the flange. It should be noted that the order of the method steps for method 400 is merely exemplary and should not be considered a limitation of the method as discussed herein.

Once the plunger and the flange have been installed and tested, the raceways are filled in during step 428 with a durable substance, such as concrete or epoxy. In any case, the surface of the slab is restored to its original condition, while simultaneously protecting the hydraulic supply line from damage. Final step 430 includes the attachment of the original superstructure to the top of the plunger sleeve. Generally, the plunger sleeve is selected to match the particular attachment manner and pattern of the original superstructure. In the event there is a different attachment, some modifications may have to be made to either the superstructure or the plunger sleeve to attach them together. In any case, such modification, which is within the skill of the skilled artisan, should be considerably less expensive than the cost of a new superstructure.

The resulting HPLV system operates with substantially less fluid (about 97% less in preferred embodiments). Because the resulting HPLV lift system operates so much less fluid, virtually any leak immediately stops the functioning of the lift. Any oil leaked will reside at the bottom of the casing (not under pressure as in other systems) and can be easily removed, the fluid expelled, and the cylinder repaired or replaced in one to two hours, so that the lift will be operational the same day.

Also, the LPHV lift systems require lubrication of plunger and/or flange assembly. In contrast, the HPLV lift system provided herein requires little maintenance. As a result, the HPLV system provided herein should operate much longer and with fewer problems. For example, prior systems require seals at the top of the casing to prevent fluid from leaking out. These seals frequently failed over time. The HPLV systems will function more smoothly since there is no air-over-oil operation.

Application of the method and the resulting lift systems

Automotive lift systems

Figure 3:
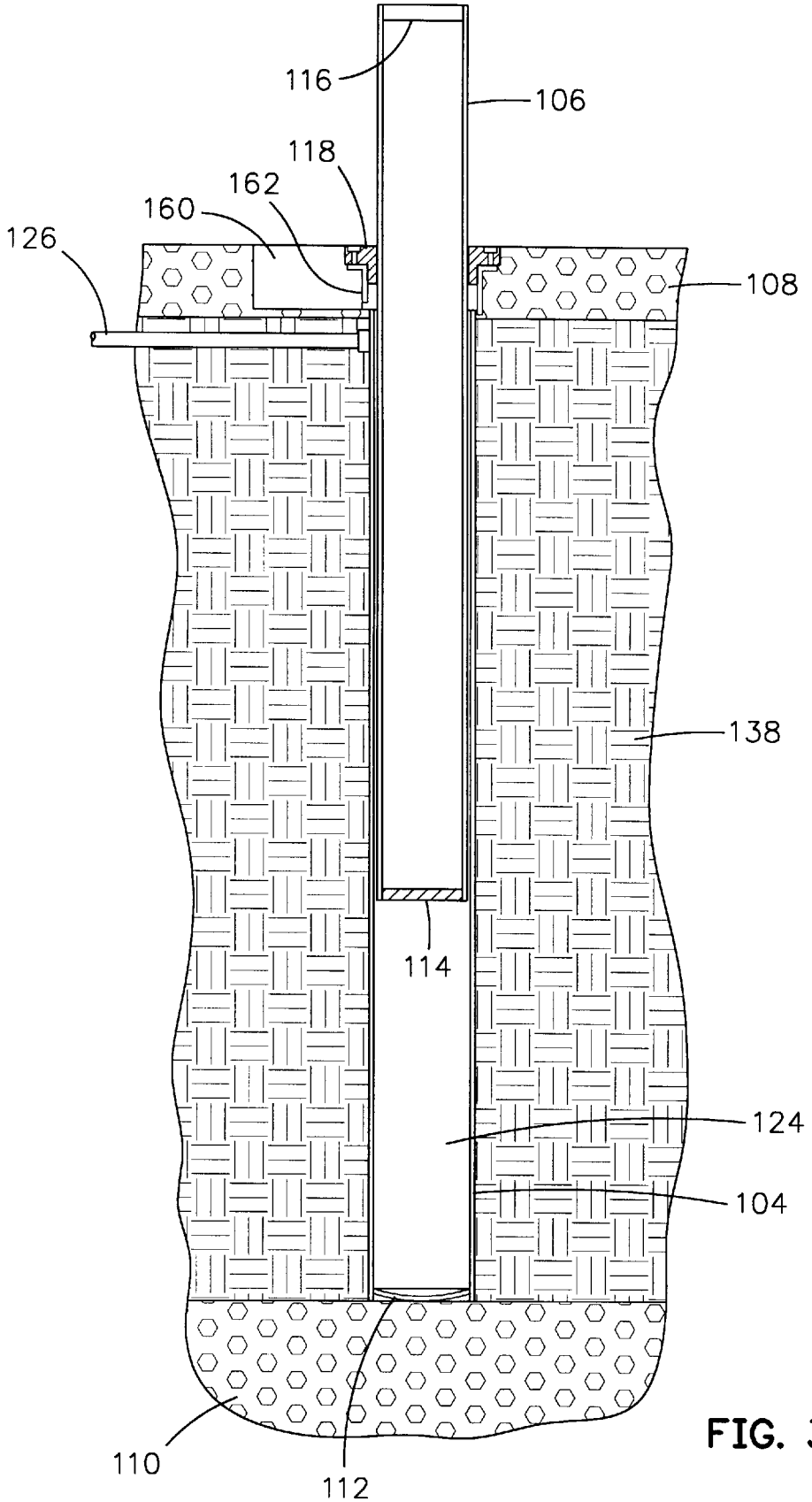
FIG. 3 is a cross-sectional view of the lift system of FIGS. 1 and 2, showing the removal of the superstructure of the pre-existing system and partial excavation of the slab to provide the attachment location of the HPLV hydraulic line.
Figure 4:
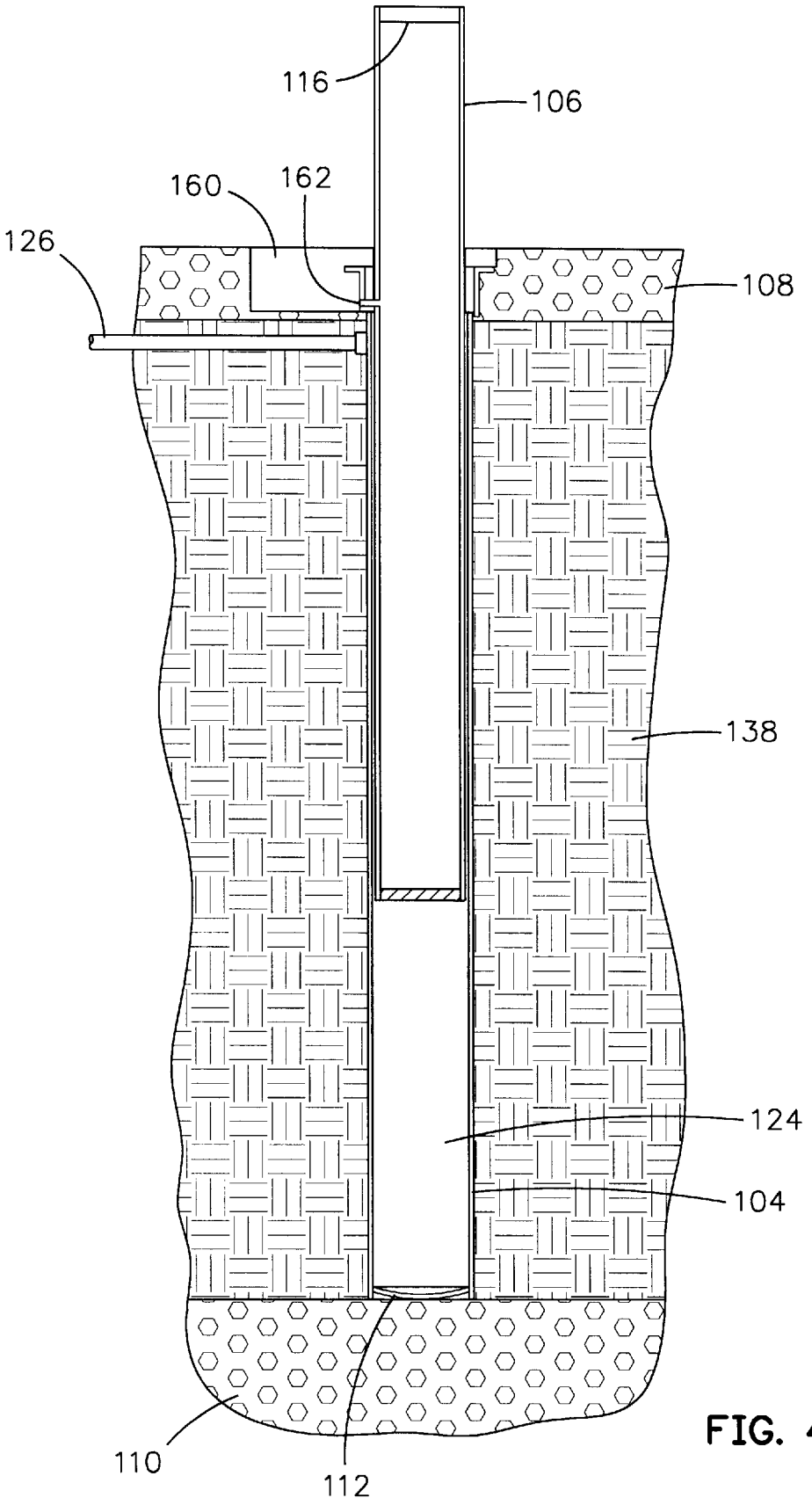
FIG. 4 is a cross-sectional view of LPHV lift system showing the removal of the gland flange.
Figure 5:
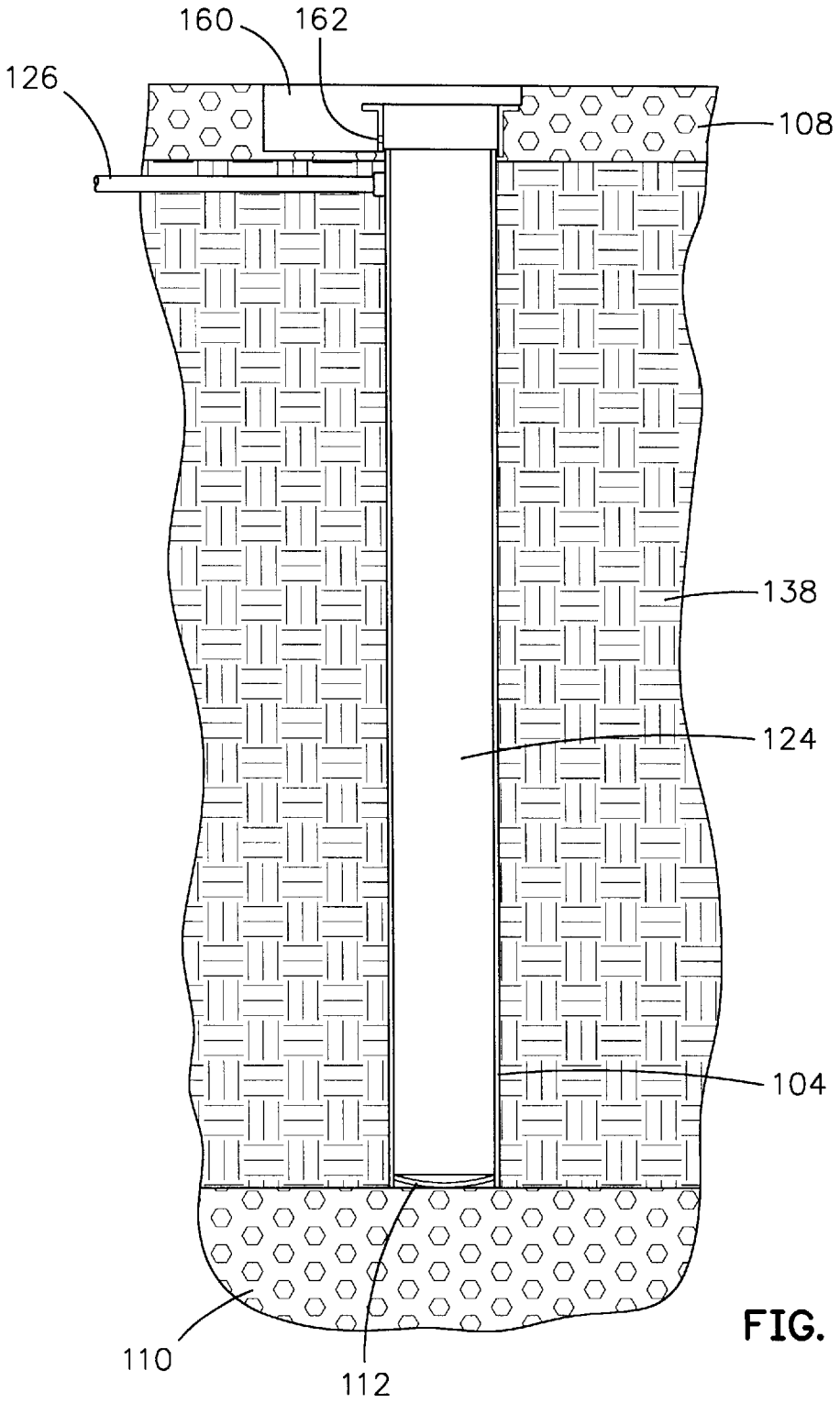
FIG. 5 is a cross-sectional view of the lift of FIG. 3 showing removal of the plunger.

Referring now to FIG. 3, a LPHV lift system is shown with the superstructure 107 removed. Following removal of the superstructure as shown in FIG. 3, the gland flange 118 is removed by removing flange attaching bolts 150 (shown in FIG. 2) and sliding the flange over the upper end of the plunger 106. With the gland flange removed, seal 122 is also removed, eliminating any pressurization with the pressurized region of the casing. This allows removal of the plunger 106 from casing 104, as shown in FIGS. 4 and 5. Once the plunger 106 has been removed, the casing and low pressure hydraulic compressor (shown in FIG. 17) are drained of any hydraulic fluid. Residual amounts of hydraulic fluid may remain, and may be suctioned out. Because the casing will not be used as a pressure chamber as it was in the LPHV lift system, it is not critical to remove all remaining hydraulic fluid, thereby facilitating the installation of the HPLV retrofit lift system.

Referring to FIG. 5, in addition to the removal of the superstructure and plunger, a portion of the slab 108 is excavated in area 160 to provide access to the side of casing 104 to form a high pressure inlet hose hole 162. Hole 162 is sized to allow passing of a high pressure hydraulic supply line 164 (shown in FIG. 6) into the casing 104.

Figure 6:
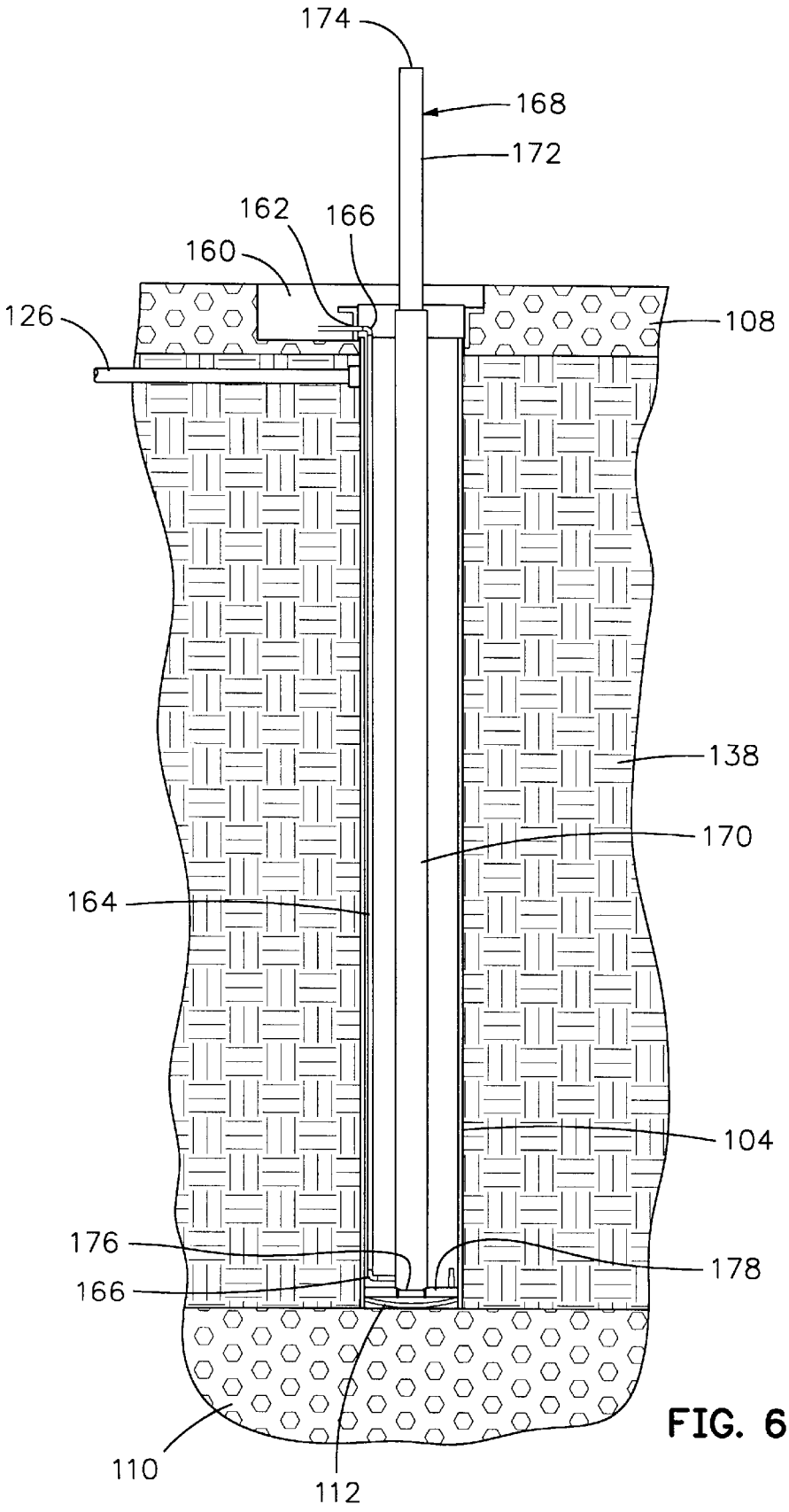
FIG. 6 is a cross-sectional view of the casing of the LPHV system, showing the installation of the HPLV hydraulic cylinder with the associated hydraulic lines and the attachment of the cylinder to a base plate on the base of the casing.

FIG. 6 shows the placement of a high pressure ram 168 axially within casing 104. High pressure ram 168 includes a ram casing 170 and a ram plunger 172. The upper end 174 of the plunger 172 is generally referred to as the attachment end, and will be equipped to attach to the superstructure of the original LPHV lift system. The lower end 176 of the ram casing 170 attaches to the base plate 178 which is firmly mounted to the casing base 112 with mounting hardware (shown in FIG. 12). This base plate 178 prevents the ram casing 170 from rotating, or from slipping away from the axial center of the casing.

Hydraulic high pressure supply line 164 is equipped with various fittings 166 such that the line 164 may be easily passed through hole 162 in casing 104 and fed down the wall of the casing to the inlet of ram 168. Supply line 164 could be made of a flexible material, however, if such a flexible material was used, it would be necessary to secure the line 164 in at least one location with the casing. This could present a problem as the casing is typically less than 12 inches in diameter, and the mounting of a fastener to the inside wall of the casing could be difficult. A rigid supply line 164, on the other hand, could be positioned to stay adjacent to the inside wall of the of casing 104.

Figure 7:
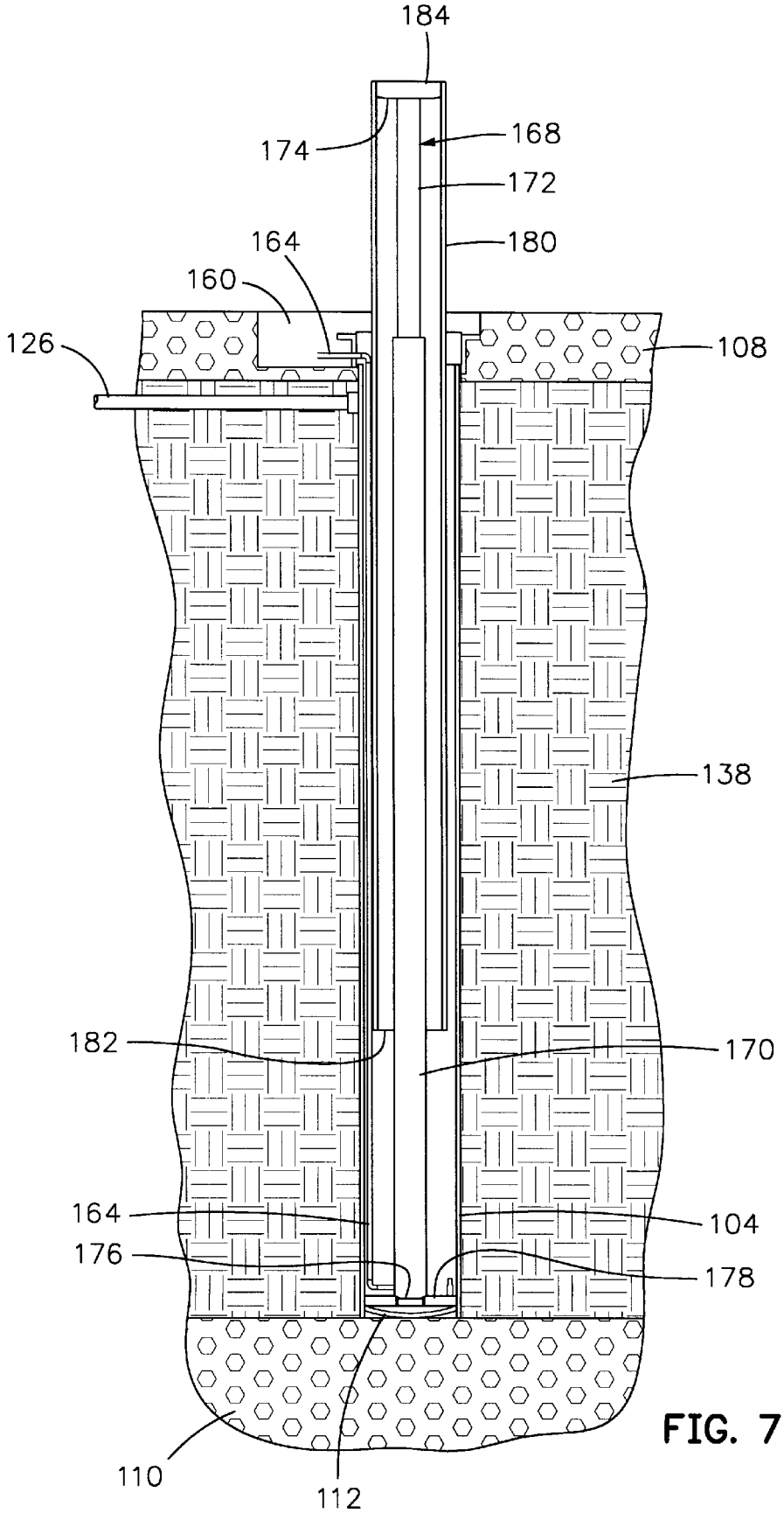
FIG. 7 is a cross-sectional view showing the installation of the new plunger over the vertically mounted HPLV hydraulic cylinder.

Referring now to FIG. 7, the ram 168 is shown extending axially upwards from casing 104, and an outer plunger sleeve 180 is positioned with lower end opening 182 positioned over the extending ram plunger 172, with upper end 184 of the plunger sleeve 180 attached to attachment end 174 of the ram plunger 172. Outer plunger sleeve 180 is sized to slide into the casing 104, and may either be the existing plunger 106 from the original LPHV lift, or may be a new plunger sleeve 180. In the event the original plunger 106 is used, there may be a need to remove the sealing plate 114, or secondary seal 140 (shown in FIG. 2). However, the cost savings of re-using a major portion of the original LPHV lift could [perhaps] make the modification of the plunger 106 a cost effective alternative.

Alternatively, a new plunger sleeve 180 can be used which could be sized similar to the original plunger 106 since the diameter of the plunger sleeve 180 is an important aspect of the HPLV lift system. The purposes for having a plunger 106, or a plunger sleeve 180 having a diameter as close as possible to the original LPHV system include the ability to accommodate the pre-existing superstructure bolt pattern, and to provide a measure of lateral stability. In fact, the high pressure ram 168 is fully capable of lifting anything within its weight capability, without the need for a plunger 106 or sleeve 180. However, when the ram plunger 172 is extended from ram casing 170, the end 174 of plunger 172 can oscillate horizontally. While there may be no danger of the high pressure ram 168 failing, it is unsettling for those working near the lift for the vehicle to be swaying above them. As a result, it is advantageous to provide a plunger sleeve 180, or plunger 106, which can increase the lateral support of the ram plunger 172, thereby minimizing the horizontal movement of the vehicle.

Figure 8:
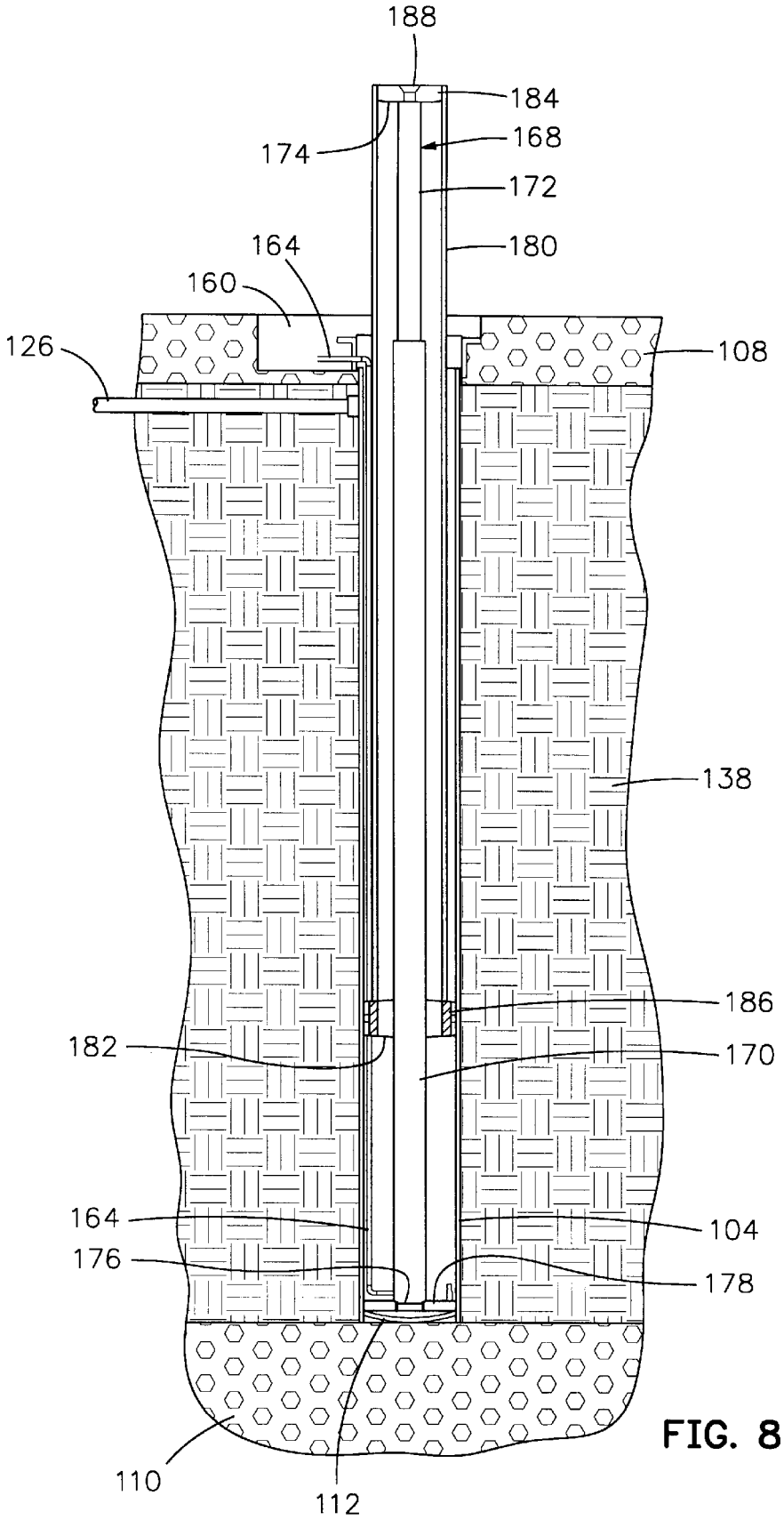
FIG. 8 is a cross-sectional view of the new plunger having an integral plunger bearing which is sized to slide within the casing.

Referring now to FIG. 8, lower end 182 of plunger sleeve 180 is shown having a bearing 186 which provides added lateral support for the plunger sleeve 180, and facilitates the vertical movement of the plunger sleeve 180 within the casing 104. In addition, the casing may be equipped with an inserted sleeve, or lining, (not shown) which would provide a smoother bearing surface for bearing 186 to engage. The addition of a lining would be particularly advantageous when the casing 104 suffers from extensive corrosion, or has significant damage, such as gouges or scoring on its inside surface.

Attachment hardware 188 is provided to firmly attach the end 174 of plunger 172 to the upper end 184 of the plunger sleeve 180. It should be noted, however, that the hardware 188 may be designed to attach to either the new plunger 180, or the plunger 106 from the original LPHV lift system. If plunger 106 is used, it may be necessary to provide mounting holes, or the like, to the end of the plunger 106 for attachment to the end 174 of the ram plunger 172.

Figure 9:
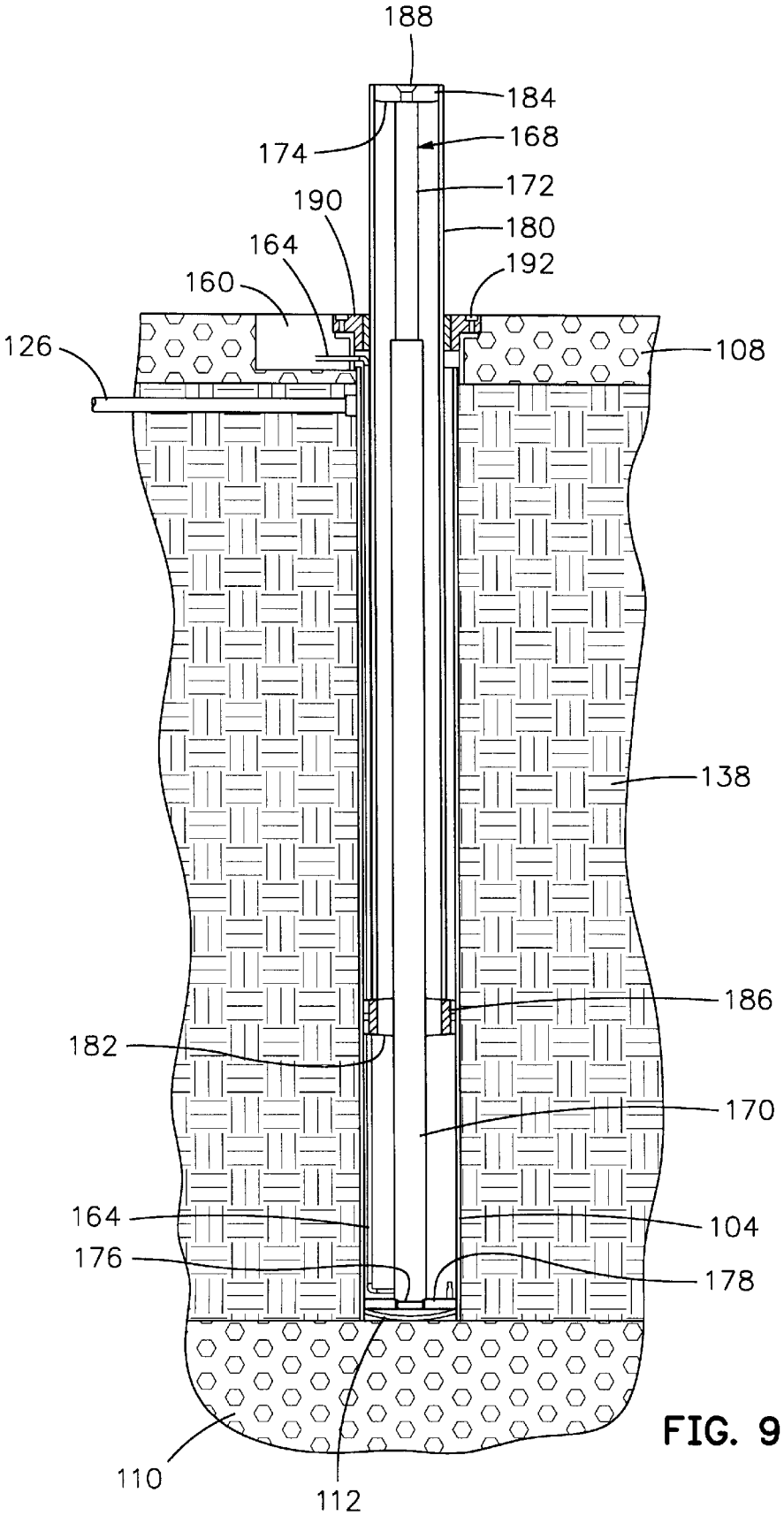
FIG. 9 is a cross-sectional view showing the addition of an upper plunger bearing attached to, or separate from, the re-installed gland flange.

FIG. 9 shows the installation of a new alignment flange 190 which is held in place around plunger sleeve 180 and inside the upper end of casing 104 with bolts 192. Alignment flange 190 cooperates with the bearing 186 to further minimize the horizontal movement of the plunger sleeve 180 by stabilizing the new plunger sleeve 180 relative to the bearing, or guide collar, 186. Accordingly, the combination of new alignment flange 190 and the bearing 186 yields an operable HPLV lift system which provides equivalent mechanical function to that of the original LPHV lift system shown in FIG. 1.

Figure 10:
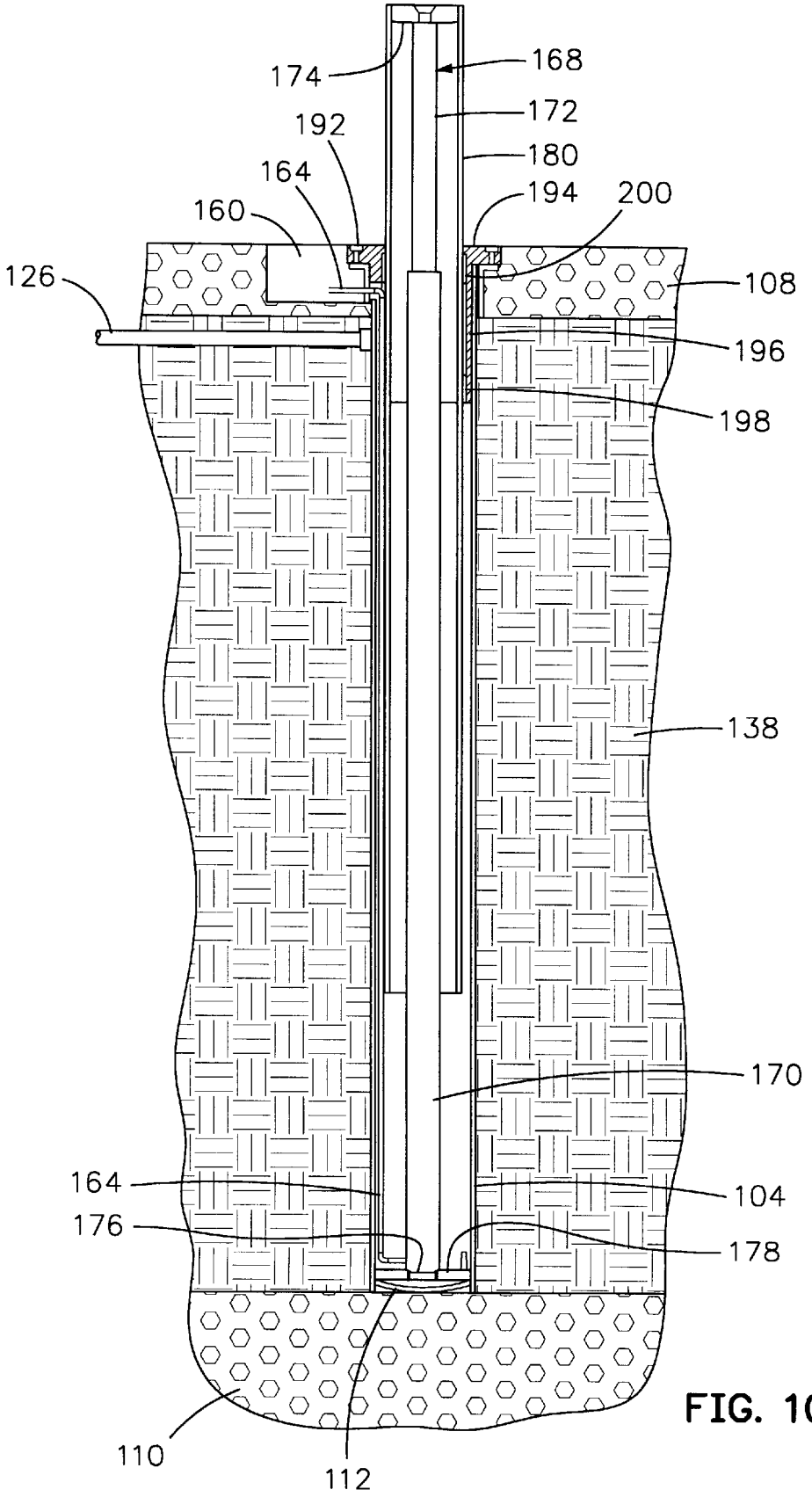
FIG. 10 is a cross-sectional view showing the addition of a new gland flange which has both an upper and lower plunger bearing.

Referring to FIG. 10, an alternative alignment flange 194 is shown and includes an alignment flange sleeve having a lower bearing pad 198 and an upper bearing pad 200. The lower and upper bearing pads 198 and 200 may be used instead of, or in combination with, lower bearing 186. In addition to the two bearings shown in FIG. 10, other bearings may be used, such as those representative bearings 202 in FIG. 15.

Figure 11:
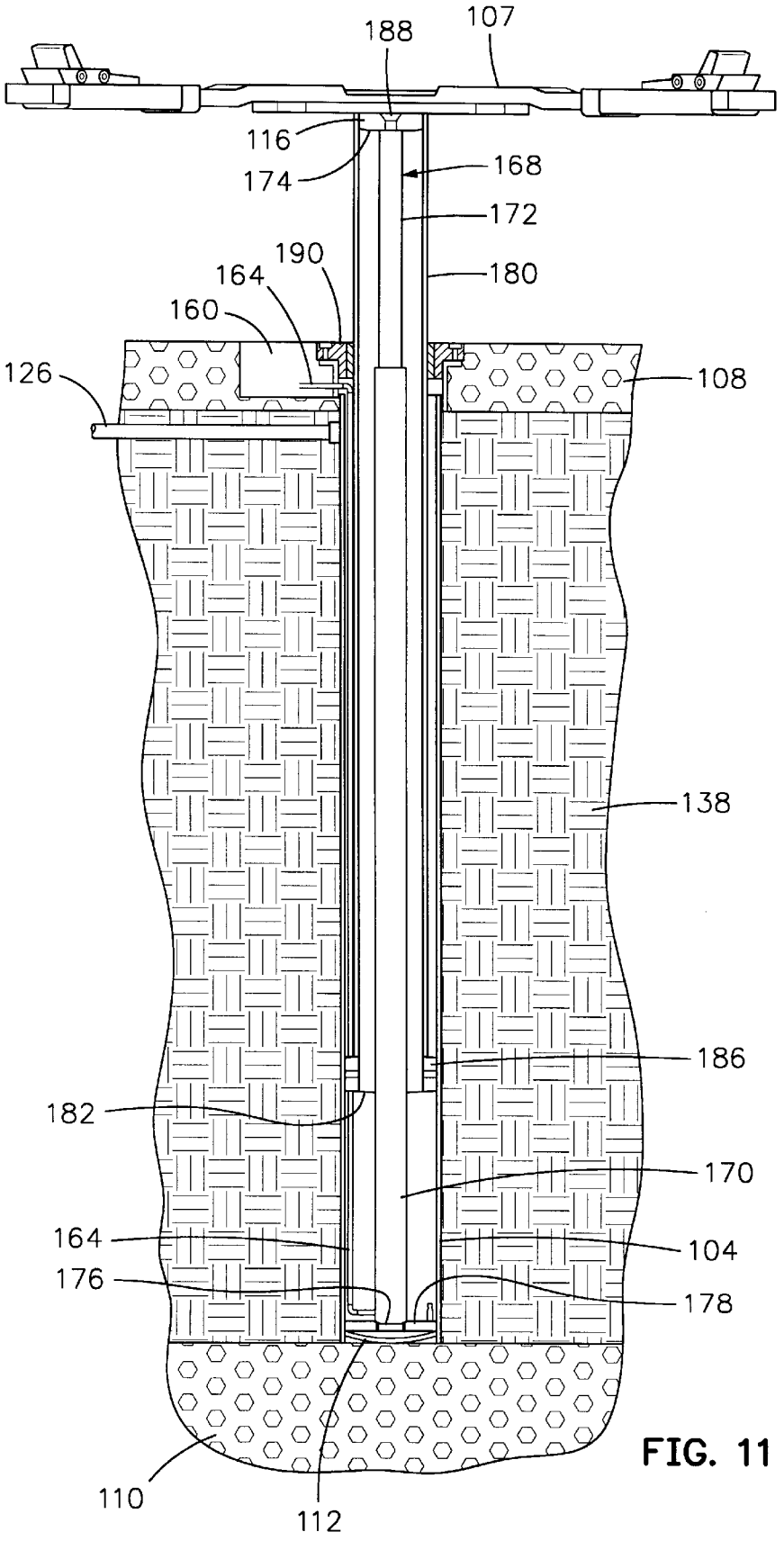
FIG. 11 is a cross-sectional view showing the installation of the pre-existing superstructure onto the plunger.

FIG. 11 shows the HPLV lift system as installed in casing 104, with superstructure 107 attached to the upper surface of the plunger sleeve 180. As mentioned above, the superstructure represents a significant portion of the expense for a lift system, and can exceed one thousand dollars. As a result, it is advantageous to provide a plunger sleeve which may accommodate the existing superstructure. This may be readily achieved since the LPHV lifts which are in widespread use today are, more likely than not, one of a select few types of lifts which have a consistent mounting pattern for their superstructures. As a result, it is possible to develop a library of mounting hole patterns which could accommodate virtually any lift system being retrofitted.

Figure 12:
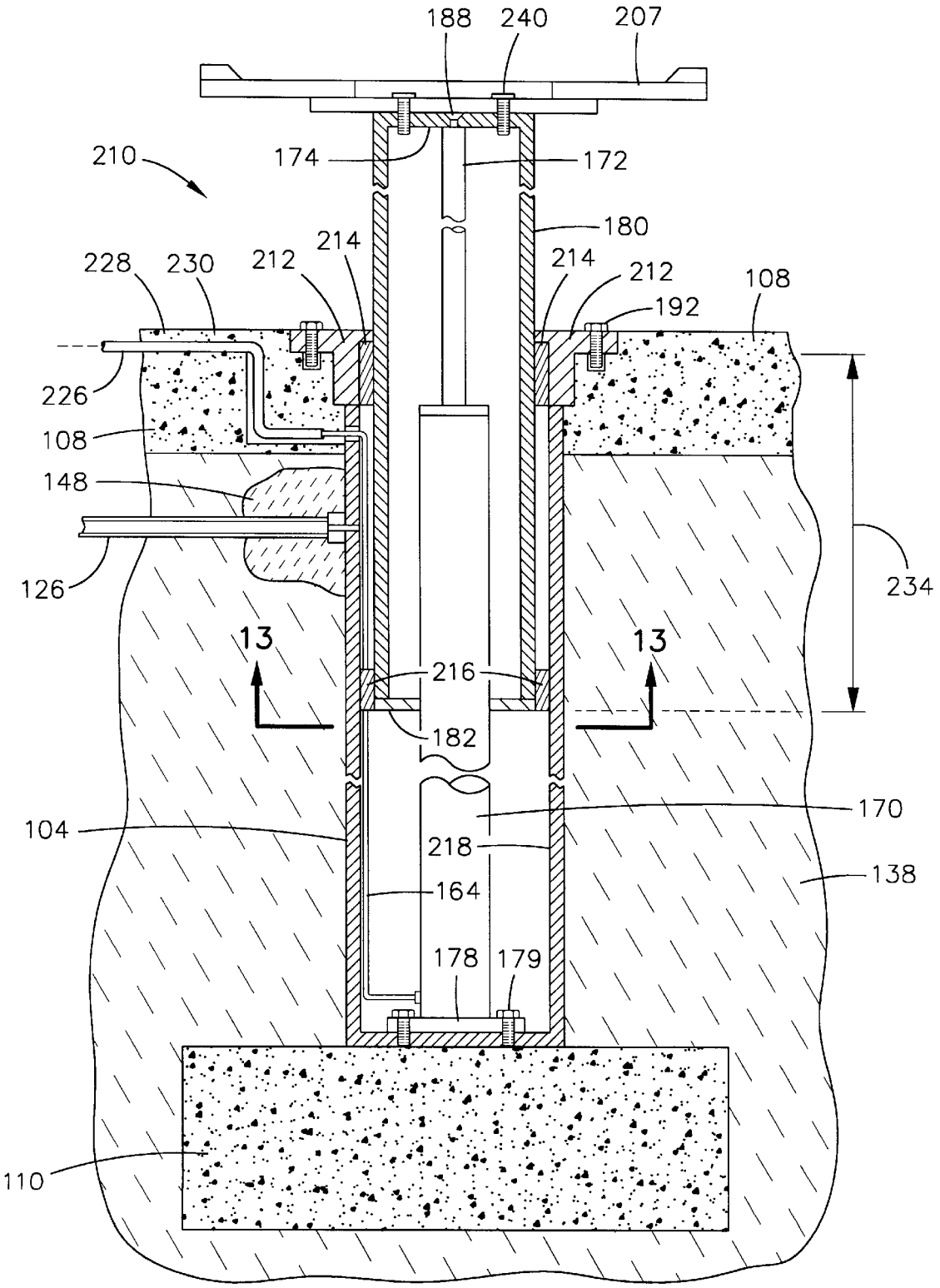
FIG. 12 is a cross-sectional view of an alternative embodiment of the HPLV lift provide herein showing the attachment of the HPLV cylinder to the base of the casing, the bearing positions on the gland flange, and the routing of the new HPLV hydraulic lines through the raceway formed in the slab.

Referring now to FIG. 12, an alternative embodiment of a HPLV lift system provided herein is shown in detail and generally designated 210, clearly identifying the various bearings, flanges, and mounting hardware. Casing 104 is shown attached to pad 110 which is designed to support the entire weight experienced by the lift system 210. A high pressure ram 170 is mounted axially within the casing 104 and extending upwards to support a plunger sleeve 180. Ram 170 is attached to the base of casing 104 with hardware 179 which prevents any movement of the ram casing 170 within the casing 104. Fluid supply line 164 attaches to the lower end of ram casing 170 and extends upwards along the inside surface of the casing 104, and out hole 162 into area 160. Once in area 160, the supply line 164 is encased in a supply line conduit 226 which prevents any damage to the supply line. To further decrease the likelihood that there is any damage to the supply line, the supply line itself is made of a steel braided hose which resists most any damage.

Figure 16:
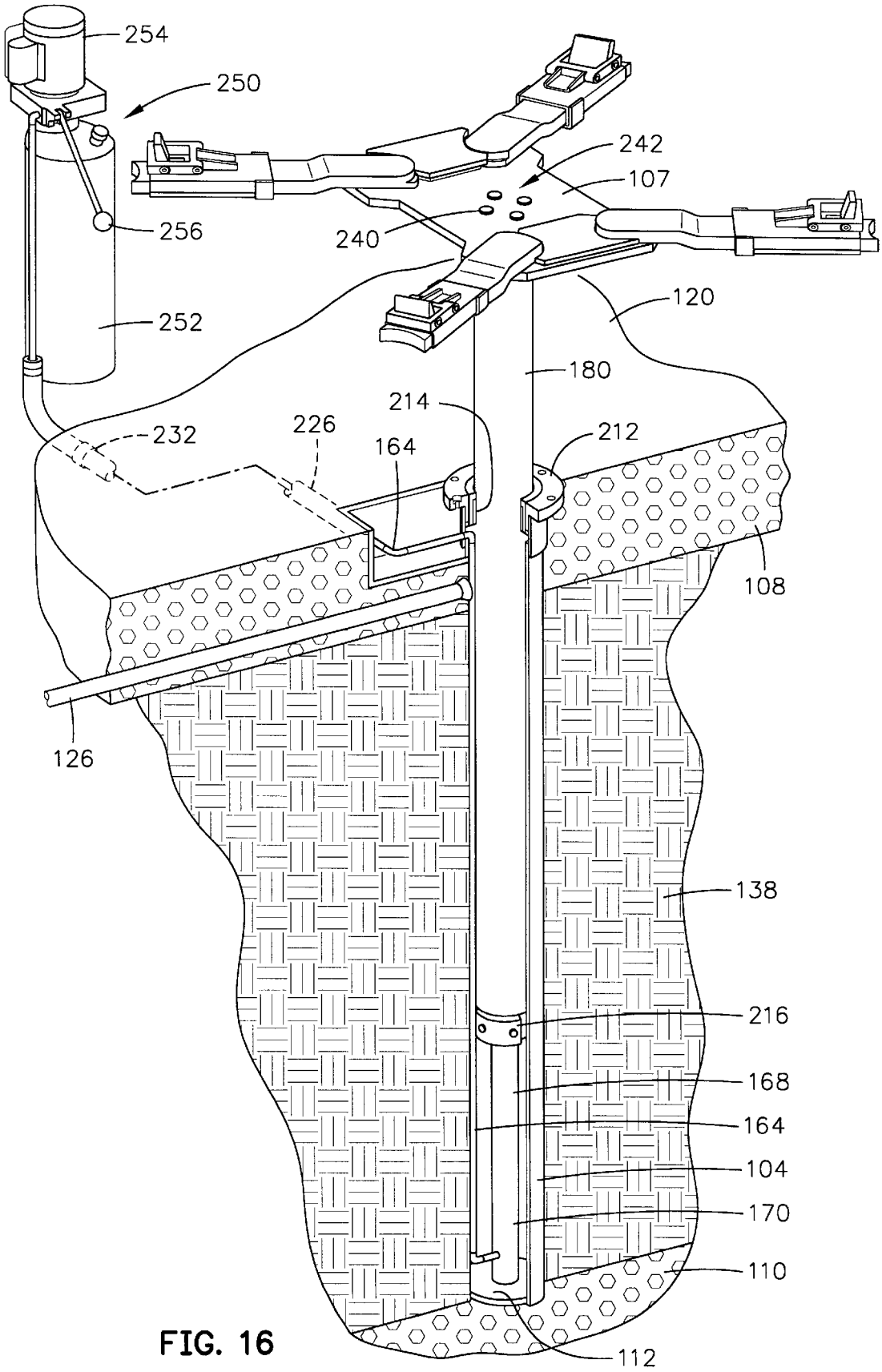
FIG. 16 is a perspective view of a completed retrofit, with portions cut away for clarity, utilizing a gland flange having a single bearing, and a bearing on the end of the plunger.

The supply conduit 226 leaves area 160 and passes through a raceway 228 formed in the slab 108 to the location of the hydraulic compressor 250 (shown in FIG. 16). Once in position, the raceway 228 is refilled with encasement material 230, such as concrete, or an epoxy material. Regardless of the material 230 used, the supply line 164 is protected safely within the supply conduit 226 which is covered by encasement material 230. In the unlikely event that a leak may occur in supply line 164, within either the supply line conduit 226, or the casing 104 the smallest loss of fluid from the system will be identifiable because the entire HPLV lift system holds less than three gallons of hydraulic fluid. Unlike the LPHV systems, any leakage that occurs within the resulting HPLV lift system will be safely captured within either the supply conduit 226 or in the casing 104. The capture of any leakage is particularly effective because, if supply line 164 leaks fluid within casing 104, the fluid will pool in the lower portion of the casing, at atmospheric pressure, where it can be safely removed simply by suction. Further, if the supply line 164 leaks fluid from a location within the supply conduit 226, the supply conduit will easily retain the entire volume of hydraulic fluid for the lift system, providing for easy identification of a leak and recovery of the renegade hydraulic fluid.

Flange 212 is shown positioned atop the casing 104 and includes a bearing pad 214. Bearing pads 214 can be an array of substantially friction-less pads which provide a bearing surface for the plunger sleeve 180 to move against. Alternatively, bearing pad 214 may be a circularly shaped bearing pad which is sized with a diameter approximately equal to the diameter of the plunger sleeve 180. In any event, these bearing pads are well known in the art and may be made of any suitable material, such as steel or Teflon.

Plunger bearing pads 216, forming a collar-like bearing, are shown mounted to the lower end 182 of plunger sleeve 180 to provide a lower bearing for the control of any ancillary movement of the plunger sleeve 180, and the attached superstructure 107. The bearings 216 slide along the inside surface 218 of the casing 104 to minimize any lateral movement of the lower portion of the plunger sleeve 180. (Note that the bearings could be eliminated by providing a plunger sleeve 180 which had a outer diameter which was very close to the internal diameter of the casing.) If such were the case, by lubricating the outer surface of the plunger sleeve 180, the effect would be the equivalent to an elongated bearing surface covering the entire outer surface of the plunger sleeve 180.

Figure 13:
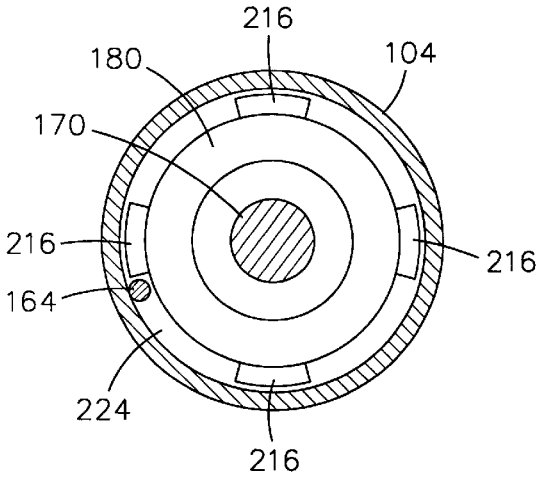
FIG. 13 a cross-sectional view taken along line 13—13 of FIG. 12, and shows the positioning of the bearing pads relative to the hydraulic line, and relative to the location of the HPLV hydraulic cylinder.
Figure 14:
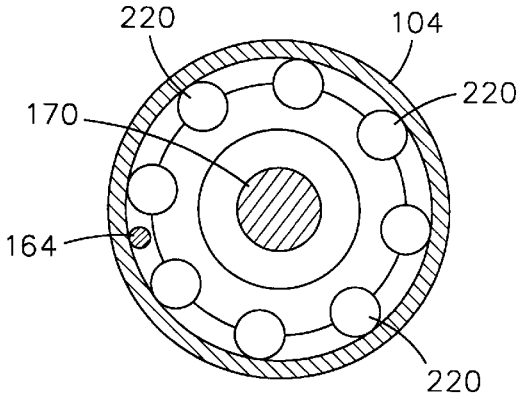
FIG. 14 is a cross-sectional view of an alternative bearing for the plunger, and includes a number of spherical bearings which roll along the inside surface of the casing.

Referring to FIGS. 13 and 14, a cross-section of lift system 210 is shown detailing the structure of the bearings 216. FIG. 13 shows a number of bearing pads 216 which are distributed around the outer surface of the plunger sleeve 180. Each bearing pad 216 has a curvature which approximates the internal surface of the casing 104. Such curvature improves bearing function by decreasing any friction caused by dissimilar bearing surfaces. The positioning of supply line 164 is shown in open space 224. This open space provides for the easy vertical movement of the plunger sleeve 180 without damaging the supply line 164. In fact, there are several open spaces in the bearing pad configuration shown in FIG. 13, and could accommodate multiple supply lines 164, and can even include wiring harnesses for sensors and other electronic equipment (not shown) which could be mounted within casing 104.

FIG. 14 shows an alternative embodiment of a bearing attached to the lower end 182 of plunger sleeve 180, and includes a circular array of spherical bearings 220 which provide a rolling bearing surface which will ride along the inside surface 218 of the casing 104. Such a configuration of spherical bearings, like the bearing shown in FIG. 13, provide for multiple open spaces to route hydraulic lines, for example. The bearing structures shown herein are merely intended to be exemplary; any such structures know to those of skill in this art may be substituted therefore. Alternative embodiments of the various bearing types are well known in the art.

It should be noted that the bearings shown in FIGS. 13 and 14 show the ram casing being concentric with the casing and plunger sleeve. Such an orientation is optional because it is not necessary for the lift system of to function properly; any suitable orientation may be selected. Installation of the ram 168 may be simplified by mounting it away from the center axis of the casing. For example, mounting the ram casing 170 near one side of the casing 104 facilitates the mounting and attachment of the ram casing 170 to the base of the casing 104 by providing more work space within the casing.

Figure 15:
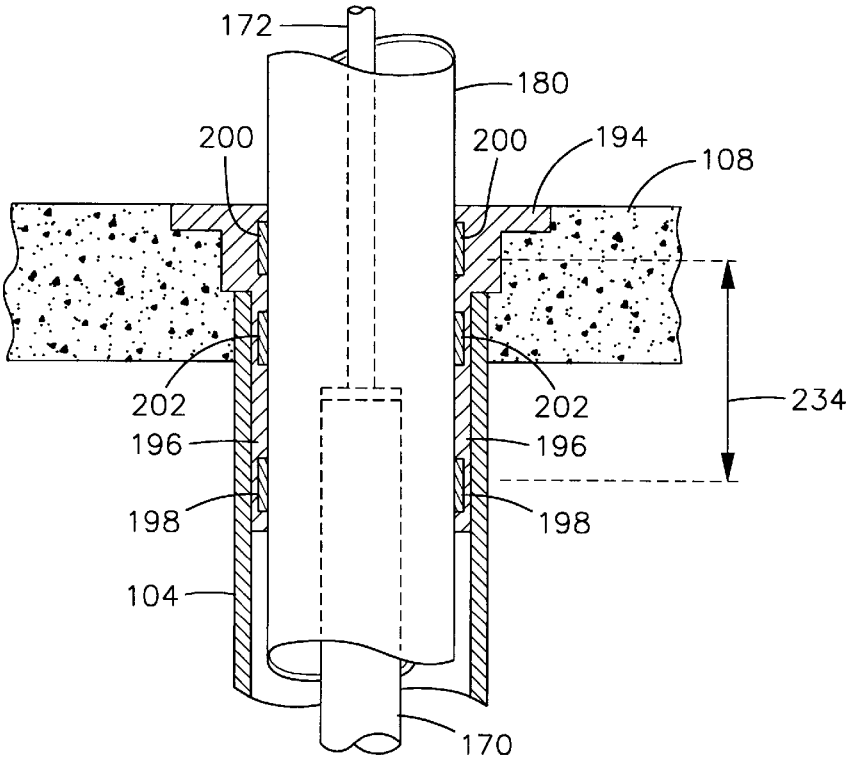
FIG. 15 is a cross-sectional view of an alternative gland flange which has multiple bearing pads to provide for more vertical stability to the plunger.

Referring now to FIG. 15, an alternative embodiment of an alignment flange 194 is shown and includes an alignment flange sleeve 196 which is equipped with a number of bearing surfaces 198, 200, and 202. Flange 194 may be equipped to provide any number of bearing surfaces to a sleeve 196 having a different length. The sleeve portion 196 of the alignment flange 194 may have a substantial length, possibly extending substantially the length of the casing 104 itself. This may be particularly useful in stabilizing any horizontal movement of the plunger sleeve 180 because the bearings 198 and 200 could be separated by a substantial distance 234. In fact, the greater the separation distance 234 between the bearing surfaces 198 and 200, the greater the stability of the plunger sleeve.

FIG. 16 is a perspective view of a typical lift system provided herein, shown in partial cross-section for clarity. The lift system of FIG. 16 includes a casing 104 from a LPHV lift system that has been equipped with a high pressure ram 168 that extends upwards to support a plunger sleeve 180. Plunger sleeve 180 has been formed with an attachment pattern 242 such that the existing superstructure 107 may be attached to plunger sleeve 180 by hardware 240. Alignment flange 212 encircles plunger sleeve 180 such that bearing surfaces 214 contact the outer surface of the plunger sleeve 180 to maintain its vertical orientation. To assist in maintaining the vertical orientation of the plunger sleeve, a lower bearing 216 is attached to the plunger sleeve to provide yet another point of lateral support.

Hydraulic supply line 164 is shown attached to the lower end of the high pressure ram 168, and extending upwards along the surface of casing 104 to hole 162 in casing 104. Once outside the casing 104 and into area 160, supply line conduit 226 encases the supply line 164 to protect the supply line, and to collect any leaking hydraulic fluid which may escape. Supply line 164 within supply conduit 226 extends through raceway 228 in slab 108 to an area near hydraulic compressor 250. Flexible portions 232 of supply conduit 226 allows the supply line to be completely protected from external injury, extending such protection from the casing 104 to the compressor 250.

Compressor 250 includes a hydraulic fluid reservoir 252 which provides hydraulic fluid to pump 254. Pump 254 is selectively actuated by actuator 256, and upon activation of the pump, hydraulic fluid is compressed into supply line 164 to extend the high pressure ram 168, raising the associated superstructure. Lowering of the superstructure is achieved by moving the actuator 256 to bleed hydraulic fluid from the supply line 164 back into the reservoir 252. This results in a completely closed hydraulic system which, with a full complement of hydraulic fluid, holds less than three gallons. Thus, even if the entire fluid capacity of the HPLV lift system was discharged, such contamination would amount to significantly less fluid than even a partial fluid leak from a LPHV lift system that holds typically at least 50 gallons. The entire fluid capacity of the HPLV system should be contained within the casing 104 or the conduit 226.

FIG. 16 illustrates an beneficial feature of pad 110, namely the stability of having high pressure ram 170 attached directly to casing base 112. This stability is due to the transfer of the majority of vertical forces experienced by hydraulic ram 170 to the pad 110, focusing such forces in one area on the pad. This localization of support in pad 110 locates a center of rotation, or torque point, at the base of the lift system. Because the support pad, and associated torque point, are located approximately nine or ten feet below slab 108, the horizontal stability of the lift system is improved. Moreover, by providing a secure point of support on pad 110 and a horizontal support bearing 214 on flange 212, the extended plunger sleeve 180 will experience very little horizontal movement, even when fully extended.

Figure 17:
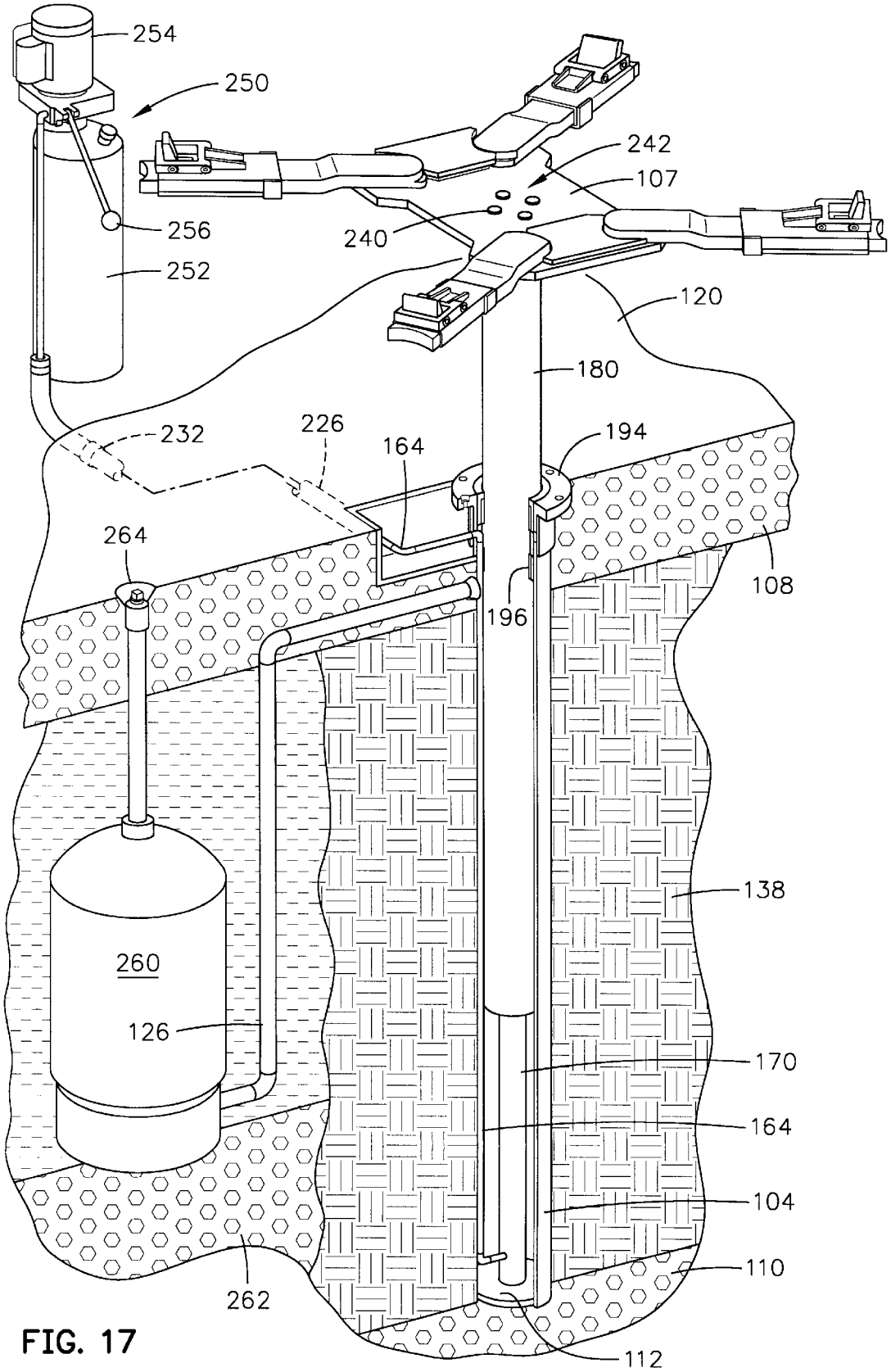
FIG. 17 is a perspective view of a completed retrofit, with portions cut away for clarity, utilizing a gland flange having multiple bearings, with no bearing on the end of the plunger, and also shows the in-ground placement of the pre-existing hydraulic tank and associated tubes, used as a breather system in the retrofit lift system.

Referring now to FIG. 17, the HPLV lift system of FIG. 16 is shown with the flange 194 and utilizing the hydraulic reservoir to provide an air pathway to accommodate the changing air volume within the casing 104 and plunger sleeve 180 as the superstructure 107 is raised and lowered. For example, as the actuator 256 is moved to pressurize supply line 164, high pressure ram 168 extends, causing the plunger sleeve 180 to move upwards, raising the superstructure 107. However, as the plunger sleeve 180 moves upwards, the air volume trapped between the casing 104 and the plunger sleeve 180 increases. If there were no air inlet into the casing, a partial vacuum would be created within the casing which would impede the movement of the plunger sleeve 180. The low pressure hydraulic fluid tank from the LPHV lift system is ideal for providing the necessary air inlet because the tank 260 is located beneath the slab 108 and can provide a large quantity of air through supply line 126 directly into casing 104. To further assist in the free flow of air into the casing 104, filler tube 264 may be modified to be a ventilation inlet, or breather hole, such that any additional air needed to equalize pressure within casing 104 may simply be drawn in through inlet 264 and into casing 104. It should be noted that the old low pressure hydraulic line 126 may be removed and replaced with a suitable breather system exiting at any convenient point above the shop floor.

Figure 18:
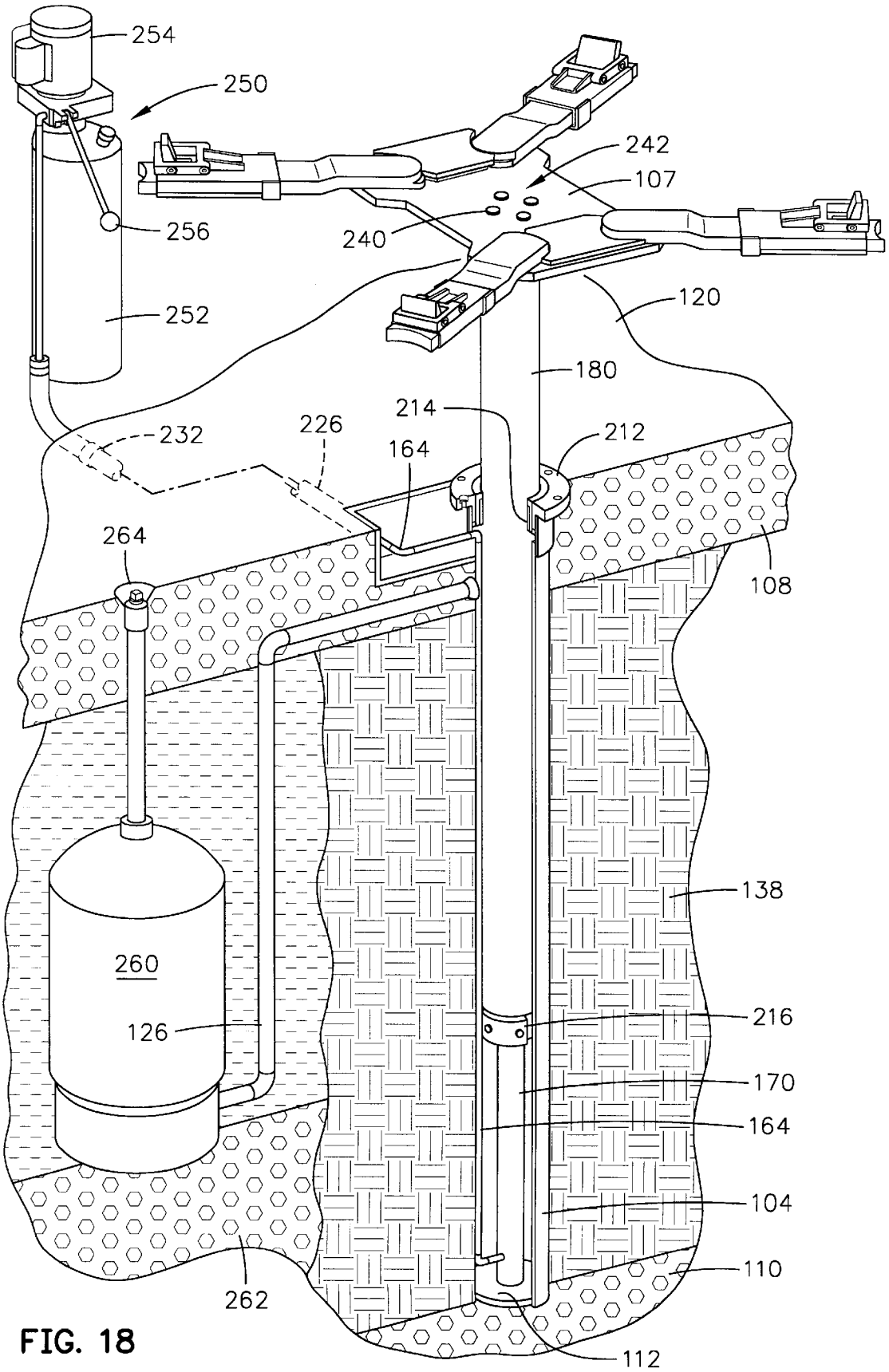
FIG. 18 is a perspective view of a completed retrofit, with portions cut away for clarity, utilizing the LPHV system tank for a breather and ventilation system for use with the HPLV lift system.

FIG. 18 represents the lift system shown in FIG. 17, with the substitution of flange 212 for flange 194. This is intended to illustrate that flanges having a variety of bearing structures are interchangeable. This is particularly useful when retrofitting LPHV lift systems having a variety of structures. For example, when a LPHV lift system was exhibiting a large degree of lateral instability, a flange 194 may be selected because of its flange sleeve 196. Alternatively, when a LPHV lift system is exhibiting an relatively small degree of lateral instability, it would be possible to use the smaller flange 212, with the possible combination of a bearing 216. As is known in the art, any number of bearing combinations could be used such that the embodiments shown herein are merely exemplary of those preferred embodiments.

It should be noted that the bearings and flanges provide alignment of the sleeve, and do not support any weight experienced by the ram, since there is no weight born by the slab, aside from some nominal frictional forces caused by the bearings. In this configuration, the entire weight of the vehicle supported by the ram is transferred to the pad. This is critical in a retrofit application because of the original design of the LPHV lift because, the original HPLV lift was designed to transfer the entire load from the hydraulic ram 102, as shown in FIG. 2, to the pad 110. In fact, there is little support given to the slab 108, as the slab is shown as typically supported only by the soil 138. In a lift system application where the soil has been contaminated by hydraulic fluid leakage, the strength of the soil may be significantly less than when the lift was originally manufactured. As a result, any use of the slab for support could prove hazardous since any weight increase exerted on the surface of the slab, other than that originally intended, could cause cracking of the slab, and in the most extreme circumstances, could cause failure of the lift system allowing the vehicle being supported to fall. Thus, any retrofit of a LPHV lift with a HPLV lift system which transfers even a portion of the force from the lift to the slab could prove to be inherently unsafe.

Figure 19:
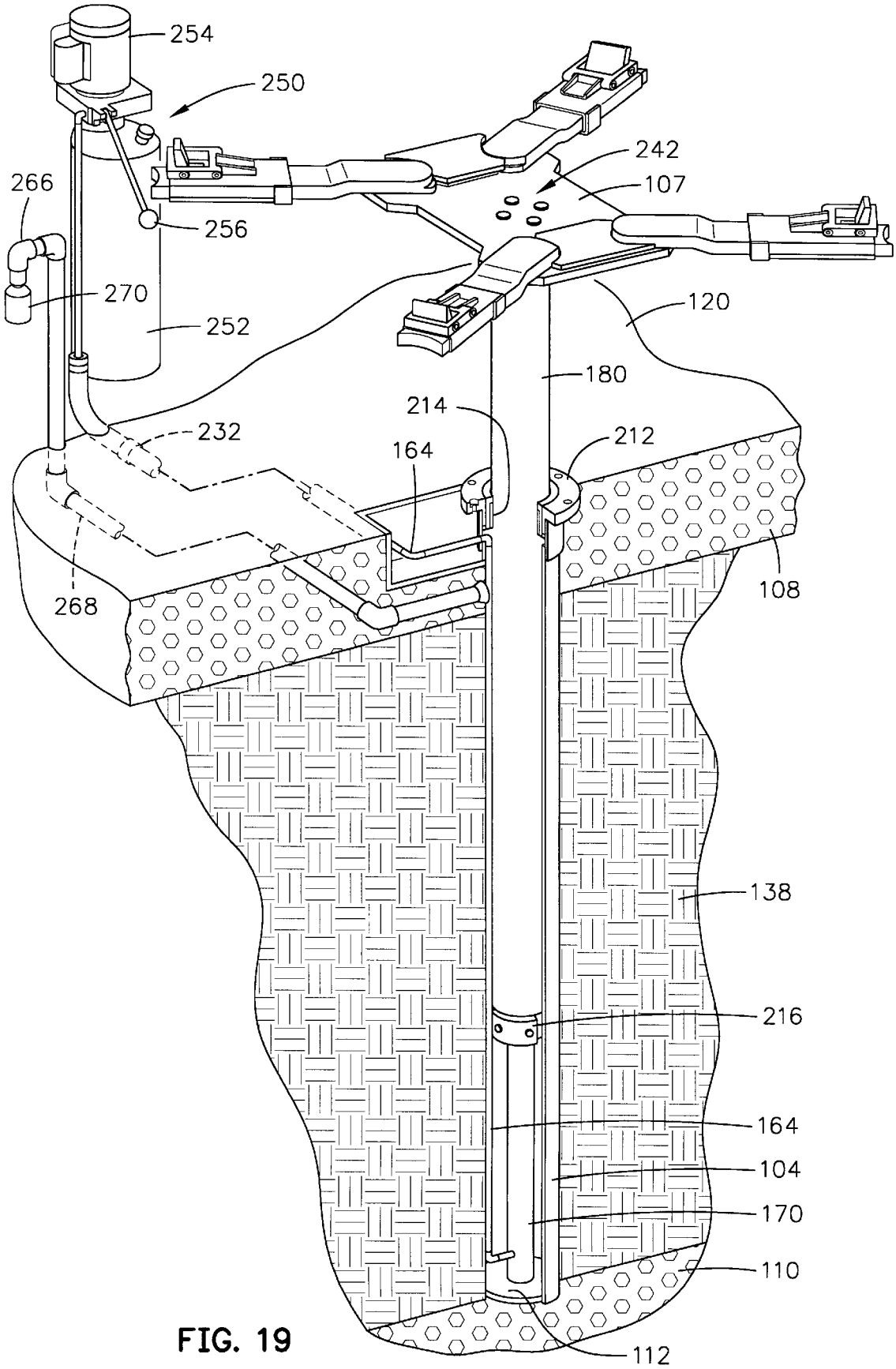
FIG. 19 is a perspective view of a completed retrofit showing the in-ground placement of a newly installed breather and ventilation system using the pre-existing hydraulic connection port as the connection point to the pre-existing lift casing.

An alternative embodiment of the HPLV lift system is shown in FIG. 19, in which the necessary air ventilation passageway to casing 104 is provided by a re-routing of supply line 126 to interface with flexible ventilation tube 268. Flexible ventilation tube 268 allows the ventilation tube 266 for the casing 104 to be located virtually anywhere. For example, as shown in FIG. 19, supply tube 126 from the LPHV lift system is re-directed to ventilation tube 266 and passed through the slab 108 via raceways (not shown), to an area which is convenient for the particular lift system installation. The ventilation tube 266 may be equipped with a filter 270 which will prevent the introduction of any foreign debris into the casing, while also insuring that any hydraulic fluid which happens to remain within the casing and supply line 126 is not blown from the ventilation tube 266 when the superstructure is lowered.

Figure 21:
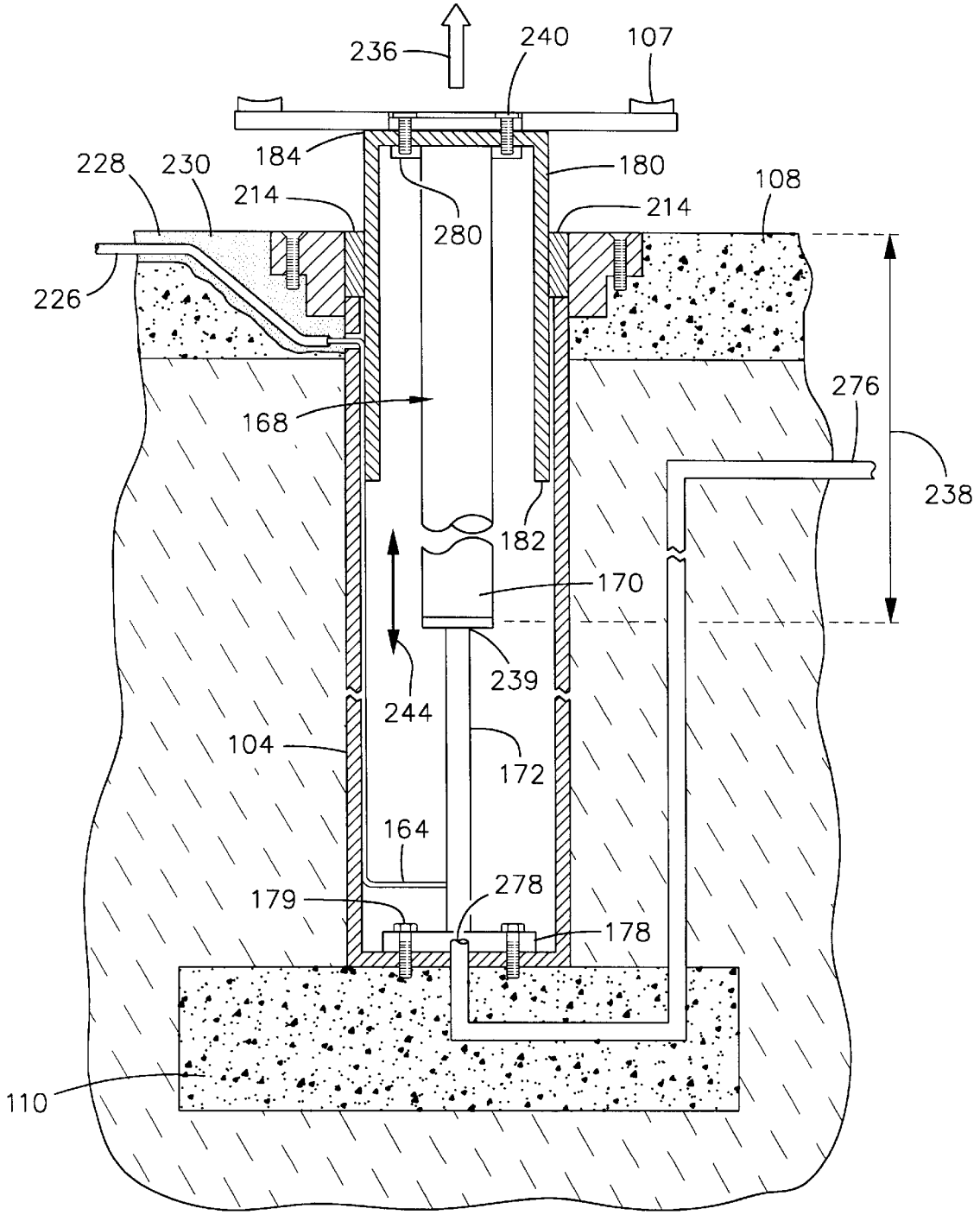
FIG. 21 is a cross-sectional view of an alternative embodiment showing a complete retrofit of an air-over-oil LPHV lift system.

Referring now to FIG. 21, a HPLV lift system is shown as installed in an air-over-oil LPHV lift system. Air-over-oil LPHV lift systems operate much like traditional LPHV lift systems, with the addition of air instead of oil to raise the plunger 180. Specifically, in an air-over-oil LPHV lift, the casing is substantially filled with hydraulic fluid, and a high pressure air supply line 276 is provided which introduces high pressure air into the pressurized region 124 to raise the superstructure and vehicle. Unfortunately, air-over-oil lift systems rely on a pressurized casing, which results in the same leakage of the hydraulic fluid.

The HPLV lift system shown in FIG. 21 includes a high pressure ram 168 mounted with its plunger 172 extending downwards from the ram casing 170 such that the ram plunger 172 is attached to the casing base 112 and the ram casing 170 is attached to the upper end of the plunger sleeve 184. In this configuration, the hydraulic supply line 164 is attached to the lower end of the ram plunger 172, instead of the ram casing 170.

The advantages of the inverted mounting of the high pressure ram 168 includes an increase in the stability of the lift system. For example, as hydraulic fluid is injected into the ram 168, the ram casing 170 and plunger sleeve 180 move upwards in direction 236, thus decreasing distance 238 between the end 239 of the ram casing 170 and the surface of the floor 108. Since ram casing 170 is firmly attached to the upper end 184 of the plunger sleeve 180, there is a constant separation distance 244 between the lower end 182 of the plunger sleeve 180, and the lower end 239 of ram casing 170. Because a small amount of flexing of the high pressure ram 168 may occur at end 239, the separation distance 244 minimizes the horizontal movement of the plunger sleeve and superstructure. Additionally, the separation distance 244 decreases the impact of any buckling forces on the hydraulic ram 168, such as lateral forces exerted on the lift system which might cause the ram 168 to buckle within plunger sleeve 180.

While not specifically shown herein, multiple HPLV systems may be used in a single application, such as to raise a large vehicle having a number of axles and trailers. These HPLV systems may be used independently with each high pressure ram having its own compressor, or two or more rams may utilize the same compressor.

Elevators

Figure 20:
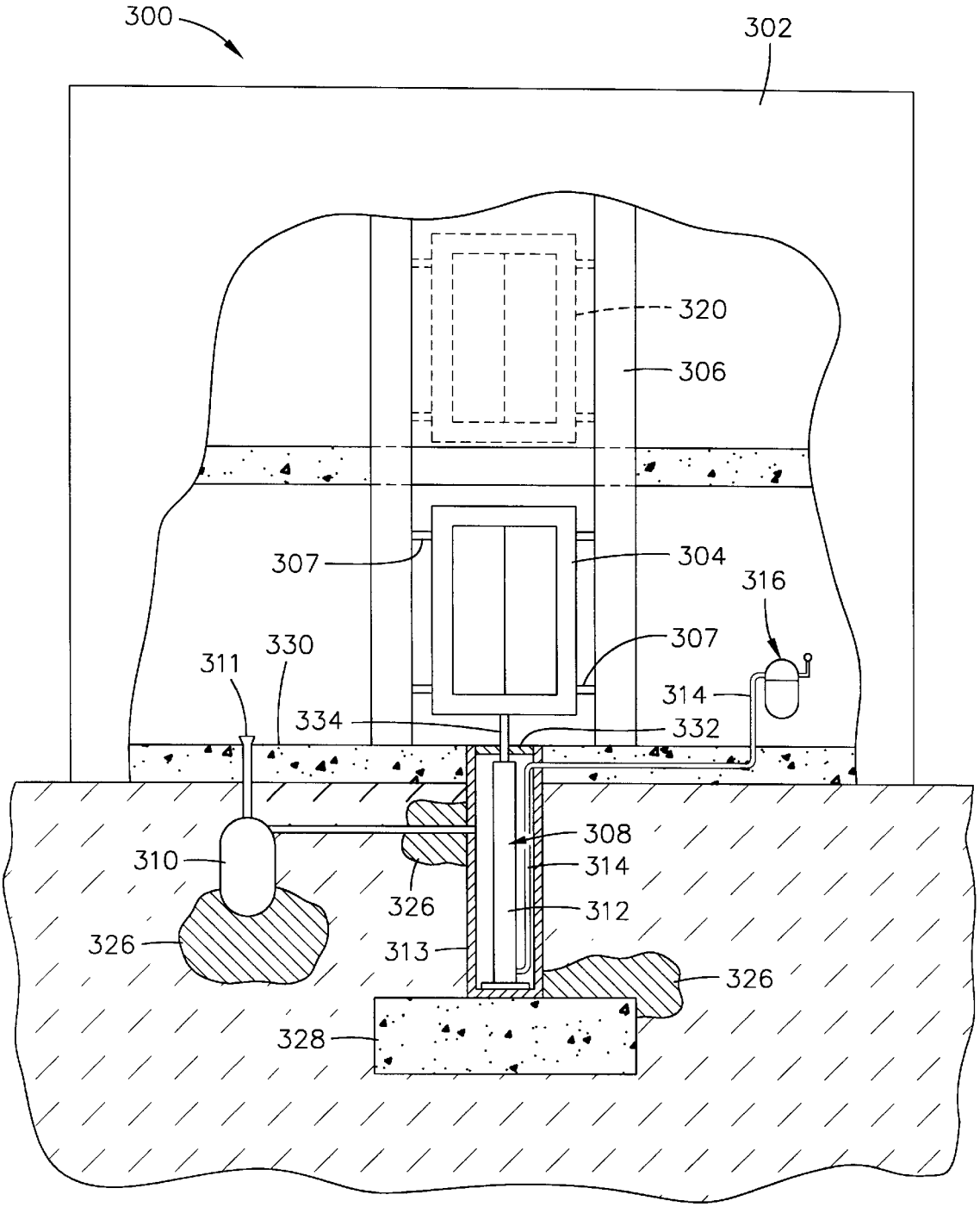
FIG. 20 is a view of a HPLV lift system as installed in a building to retrofit an elevator, with portions cut away from the building for clarity.

Referring now to FIG. 20, a HPLV lift system is shown as installed in a LPHV commercial elevator, and is generally designated 300. Lift system 300 is installed in a building 302 and includes an elevator car 304 which travels vertically within an elevator shaft 306 and is stabilized by alignment rollers 307. The LPHV lift system that was originally installed in building 302 includes a LPHV compressor and reservoir 310 that is buried beneath the building, and has contaminated soil areas 326 by the leakage of hydraulic fluid. Hydraulic reservoirs used for elevator application are not always buried, but can alternatively be located within an elevator room adjacent to the elevator shaft.

As retrofitted herein, the vertical movement of elevator car 304 is controlled by HPLV lift 308 which includes ram 312 mounted vertically within casing 313 such that plunger 334 attaches to the bottom of the elevator car 304. Hydraulic supply line 314 attaches to ram 312 and extends upwards along the wall of casing 313 and through slab 332 to high pressure hydraulic compressor 316. Compressor 316 is selectively activatable to provide the necessary hydraulic fluid pressure to pressurize and extend ram 312. As the ram 312 is extended, the plunger 334 pushes upwards on elevator car 304 to raise the car. The entire load of the elevator car is transferred through the HPLV ram 312 to support pad 328, just as in the alternative embodiments discussed above. Hence, there is virtually no force exerted on the slab 332.

One problem associated with LPHV lift systems is the compressibility of the hydraulic fluid leading to difficulty in precisely controlling the height of the elevator car 304. When the elevator car 304 is held in position 306, where the ram is extended, the ram is filled with hydraulic fluid. If a significant weight is added to the elevator car 304, the hydraulic fluid compresses and the ram shortens, effectively lowering the elevator car. This is not a significant problem in the automotive lift industry as it is rare that a significant amount of weight will be added to a vehicle while suspended by a lift. Since an elevator lift system is intended to move objects, often adding significant weight, between floors of a building, it can become a problem in the elevator lift industry.

The retrofit of an elevator LPHV lift system to a HPLV lift system alleviates much of the problem with the compressibility of the hydraulic fluid. For example, because the pressure in ram 312 of elevator system 300 is typically in the range of 2500 psi, the addition of even a substantial weight will have little effect on the pressure within the ram 312. Thus, as a result of retrofitting a LPHV lift system with the HPLV lift system provided herein, a number of problems with elevator lift control may be resolved.

In an effort to assist in the proper location of the plunger 334, a guide flange 332 may be installed at the top of the casing 313 which provides for lateral stability of the lift system. Such lateral stability is not generally necessary as the elevator car 304 is maintained in a rigid vertical path by elevator shaft 306 and alignment rollers 307. However, the addition of the guide flange 332 would eliminate any danger of buckling, or bending of the high pressure ram 308 when in its fully extended configuration.

While there has been shown and described preferred embodiments provided herein, it is to be appreciated that the system and methods may be embodied otherwise than is herein specifically shown and described and that, within each embodiment, certain changes may be made in the form and arrangement of the parts without departing from the underlying ideas or principles as set forth in the claims appended herewith. Since modifications will be apparent to those of skill in this art, it is intended that this invention be limited only by the scope of the appended claims.

I claim:

1. A hydraulic lift system for placement within a first casing of a pre-existing low pressure, high volume hydraulic lift, the first casing comprising an enclosed base portion disposed on a support pad, the hydraulic lift system comprising:

a second casing having a closed lower end and second volume less than the first volume, the second casing disposed within the first casing, wherein the closed lower end abuts an interior surface of the enclosed base portion of the first casing;

a plunger that closely fits within the second casing;

at least one hydraulic seal between the plunger and the second casing for retaining hydraulic fluid under high pressure within the second casing;

a fluid supply line having for delivering fluid to the second casing, wherein one end is attached to a connector in the second casing, and the other end is disposed within a space between the second casing and the first casing; and a compressor for pumping the hydraulic fluid from a fluid source through the fluid supply line into the closed lower end of the second casing.

2. The hydraulic lift system for placement within a first casing of a pre-existing low pressure, high volume hydraulic lift of claim 1, further comprising:

attachment means for fixedly attaching the closed lower end of second casing to the base portion of the first casing, wherein:

the first casing has a first diameter, a first volume, a first axis, and an enclosed base portion disposed on a support pad;

the second casing is substantially cylindrical with a second diameter smaller than the first diameter, has an open upper end, a closed lower end, a second axis, and a second volume less that the first volume, the second casing is disposed within the first casing whereby a space is defined between an exterior sidewall of the second casing and an interior sidewall of the first casing, and the closed lower end abuts an interior surface of the enclosed base portion of the first casing;

the plunger has an outer diameter that closely fits within the second casing, an upper end and a lower end, and is disposed within the second casing for movement therein;

at least one hydraulic seal between the plunger and the second casing for retaining a hydraulic fluid under high pressure with the second casing;

the fluid supply line has a first end in a first section and a second end in a second section, the first end is attached to a connector near the closed lower end of the second casing, the first section of the fluid supply line is disposed within the space between the second casing and the first casing, and the second section of the fluid supply line exits the first casing;

the compressor and the fluid source are connected to the second end of the fluid supply line exterior to the first casing.

3. The system of claim 2, wherein the axis of the first casing is substantially parallel to the axis of the first casing;

the plunger is substantially coaxially disposed within the second casing for vertical axial movement therein.

4. The lift system of claim 1, wherein the volume of the second casing is substantially less than that of the first casing.

5. The hydraulic lift system of claim 1, wherein the fluid source is a hydraulic fluid reservoir.

6. The hydraulic lift system of claim 2, wherein the first casing extends downward from a slab and the compressor and the fluid source are disposed above the slab.

7. The hydraulic lift system of claim 1, wherein the fluid supply line is formed from a rigid material.

8. The hydraulic lift system of claim 1, wherein the fluid supply line is encased within a supply line conduit.

9. The hydraulic lift system of claim 1, wherein the fluid supply line is formed from a steel braided hose.

10. The hydraulic lift system of claim 1, wherein the fluid source provides less than about 6 gallons of hydraulic fluid.

11. The hydraulic lift system of claim 1, wherein the fluid source provides less than about three gallons of hydraulic fluid.

12. The hydraulic lift system of claim 1, further comprising a substantially cylindrical plunger sleeve having a third diameter that is less than the first diameter and greater than the second diameter, an upper end and a lower end, the upper end of the plunger sleeve supported on the upper end of the plunger so that the plunger sleeve is disposed within the space between the first casing and the second casing and moves axially with the plunger.

13. The hydraulic lift system of claim 12, further comprising an alignment flange disposed at an upper end of the first casing and having an internal flange diameter adapted to slidably fit around the plunger sleeve whereby the alignment flange provides lateral support to the plunger sleeve.

14. The hydraulic lift system of claim 13, wherein the alignment flange includes an alignment flange sleeve extending downward from the upper end of the first case so that the alignment flange sleeve is coaxial with the plunger sleeve.

15. The hydraulic lift system of claim 13, further comprising at least one bearing pad, the at least one bearing pad attached to the alignment flange to provide a bearing surface between the plunger sleeve and the alignment flange.

16. The hydraulic lift system of claim 12, further comprising at least one bearing pad attached to the plunger sleeve, the at least one bearing pad adapted to closely and slidably fit within the first casing to provide lateral support of the plunger sleeve within the first casing.

17. The hydraulic lift system of claim 16, wherein the at least one bearing pad comprises a plurality of bearing pad sections, the plurality of bearing pad sections being spaced around the plunger sleeve to provide a gap for movement along the fluid supply line.

18. The hydraulic lift system of claim 12, further comprising a ventilation means for compensating for changes in an air volume between the first casing and the plunger sleeve as the plunger sleeve moves within the first casing.

19. The hydraulic lift system of claim 18, wherein the ventilation means comprises a ventilation tube having a first end attached to the first casing and having a second end vented to atmosphere.

20. The hydraulic lift system of claim 1, wherein the fluid source has a fluid volume on the order of 97% less than a fluid volume of the pre-existing low pressure, high volume lift.

21. A hydraulic lift system for use in retrofitting a low pressure high volume lift system integrated within a structure having a floor, wherein the low pressure high volume lift system includes a first casing with an open upper end extending downward from the floor and having a closed lower end supported on a support pad, the first casing having an axis and an inner diameter, the hydraulic lift system comprising:

a high pressure low volume (HPLV) hydraulic ram adapted to fit within the first casing with a spacing defined between an inner wall of the first casing and an outer wall of the ram, the ram comprising a plunger slidably disposed within a second casing for movement within of the first casing, the second casing having a base portion supported within and attached to the closed lower end of the first casing, wherein the plunger is adapted be extend upward from the floor.

22. The system of claim 21, further comprising:

a plunger sleeve attached to an upper end of the plunger for axial movement therewith and having a substantially cylindrical shape with an outer diameter adapted to slidably fit within the inner diameter of the first casing;

a fluid supply line connected at a first end near the base portion of the second casing for conducting a hydraulic fluid into the second casing;

a HPLV compressor connected at a second end of the fluid supply line for pressurizing the hydraulic fluid into the second casing for forcing the plunger and the plunger sleeve to extend upward from the second casing and the floor, wherein the plunger is slidably disposed within the second casing for movement parallel to the axis of the first casing.

23. The hydraulic lift system of claim 22, further comprising a superstructure attached to the upper end of the plunger for supporting a vehicle to be lifted.

24. The hydraulic lift system of claim 22, further comprising an alignment flange disposed at the upper end of the first casing, the alignment flange having an inner diameter adapted to closely and slidably fit the plunger sleeve.

25. The hydraulic lift system of claim 24, further comprising at least one bearing surface disposed on an inner surface of the alignment flange for contacting an outer surface of the plunger sleeve.

26. The hydraulic lift system of claim 22, further comprising an elevator car attached to the upper end of the plunger.

27. An automotive lift system, the system having a low pressure high volume hydraulic ram including a casing having an upper end and a closed lower end supported on a support pad, and a plunger having an upper end and a lower end, the first casing extending vertically downward from a floor surface, the plunger disposed axially within the casing and extendable partially from the upper end, the upper end of the plunger having a superstructure attached thereto, the lift system comprising:

a high pressure low volume hydraulic ram positioned axially within and fixedly attached at the lower end of the casing and having an extendable length substantially equal an extendable length of the plunger, wherein a space is formed between an outer surface of the high pressure low volume hydraulic ram and an inner surface of the casing;

a hydraulic fluid supply line adapted for supplying a hydraulic fluid at a high pressure to the high pressure low volume hydraulic ram, the supply line disposed within the space along the inner surface of the casing and exiting the casing near the upper end; and a compressor connected to the supply line for pressurizing the hydraulic fluid for activation of the high pressure low volume hydraulic ram to lift the superstructure, wherein wherein the ram is mounted to the closed lower end of the casing and extends vertically upwards therefrom.

28. The automotive lift system of claim 27, further comprising an alignment flange attached to the upper end of the casing and having an inner diameter adapted to slidably receive the plunger and to provide vertical stabilization thereto.

29. The automotive lift system of claim 28, further comprising at least one bearing, the bearing disposed on an inner surface of the alignment flange in contact with the plunger.

30. The automotive lift system of claim 28, further comprising an alignment sleeve extending from the alignment flange, the alignment sleeve having an inner sleeve diameter and a length, the inner sleeve diameter adapted to fit the plunger, and the length adapted to provide an increase in the vertical stability of the plunger.

31. The automotive lift system of claim 27, wherein the compressor is disposed above the floor surface.

32. A method for retrofitting a low pressure high volume lift system having a casing extending downward from a floor surface and from which a plunger is vertically extendable in response to the introduction of hydraulic fluid into a compression region within the casing by selective operation of a low pressure hydraulic compressor in fluid communication with the compression region, wherein the method for retrofitting comprises:

removing the plunger;

removing any remaining hydraulic fluid from the casing;

installing a high pressure ram within the casing such that the ram is fixedly attached to and extends vertically from the bottom of the casing, the ram having a ram plunger, a ram casing with a hydraulic supply line attached thereto; and attaching a high pressure hydraulic compressor to the hydraulic supply line for providing hydraulic pressure to the ram.

33. The method of claim 32, further comprising attaching a plunger sleeve to a top of the ram plunger, wherein:

the plunger sleeve has an outer diameter that fits within the casing, and the plunger sleeve is extends vertically from the casing upon activation of the hydraulic compressor.

34. The method for retrofitting a low pressure high volume lift system of claim 33, further comprising attaching a superstructure to the plunger sleeve, the superstructure adapted for supporting a vehicle, wherein activation of the compressor raises the superstructure vertically from the floor surface.

35. The method for retrofitting a low pressure high volume lift system of claim 33, further comprising attaching an alignment flange to an upper end of the casing, the alignment flange having an inner diameter adapted to guide the plunger sleeve to prevent lateral movement.

36. The method for retrofitting a low pressure high volume lift system of claim 33, further comprising attaching at least one bearing pad to an inner surface of the alignment flange so that the at least one bearing pad contacts and provides a bearing surface for an outer surface of the plunger sleeve.

37. A method of retrofit of a pre-existing in-ground automotive lift system, comprising:

(a) removing, hydraulic fluid, a plunger and guide means of the pre-existing system;

(b) installing a self-contained or sealed high pressure, low volume hydraulic cylinder and associated hydraulic lines within the casing of the pre-existing system, wherein the lower end of the low volume system abuts the bottom of the casing of the preexisting system;

(c) installing a power unit for the high pressure, low volume hydraulic cylinder; and (d) installing of a plunger associated with the high pressure low volume cylinder using the casing as an outer guide means for the plunger.

38. The method of claim 37, further comprising:

(e) replacing the superstructure of the pre-existing system.

39. A method of retrofit of claim 37, comprising:

(a) removing of a superstructure of the pre-existing system;

(b) excavating any solid structure surrounding the lift casing of the pre-existing system;

(c) evacuating hydraulic fluid from the pre-existing system;

(d) removing the guide means associated with a plunger of the pre-existing structure;

(e) removing the plunger of the pre-existing system;

(f) installing a self-contained or sealed high pressure, low volume hydraulic cylinder and associated hydraulic lines within the casing of the pre-existing system;

(g) installing a power unit for the pressure, low volume hydraulic cylinder;

(h) installing a plunger associated with the high pressure low volume cylinder using the casing as an outer guide means for the plunger; and (i) replacing the superstructure of the pre-existing system.

40. The method of claim 38, further comprising the step of: mechanically locking the high pressure hydraulic cylinder to a surface of the lift casing of the pre-existing system.

41. The method of claim 40, further comprising the step of:

providing an upper bearing structure between an upper surface of the plunger and the re-inserted guide means of the pre-existing system.

42. The method of claim 38, wherein the installation step (f) includes the step of:

providing a mounting means for interface between peripheral geometries of the pre-existing system and high pressure cylinder.

43. The method of claim 39, in which the installation Step (g) includes the step of:

providing a hydraulic tank and selectably actuatable pump means associated therewith.

44. The method of claim 41, further comprising the step of:

providing a secondary containment about the high pressure hydraulic cylinder.

45. The method of claim 44, further comprising the step of:

providing a secondary containment about the hydraulic lines associated with the high pressure cylinder.

46. The method of claim 37, wherein the resulting lift comprises an automotive lift.

47. The method of claim 37, wherein the resulting lift comprises an elevator lift.

* * * * *

UNITED STATES PATENT AND TRADEMARK OFFICE

CERTIFICATE OF CORRECTION

PATENT NO. : 5,860.491

DATED : January 19, 1999

INVENTOR(S) : Robert H. Fletcher

It is certified that error appears in the above-identified patent and that said Letters Patent is hereby corrected as shown below:

In Claim 1, col. 18, line 13, delete "having";
In Claim 3, col. 18, line 57, delete "first" and insert -second-;
In Claim 14, col. 19, line 27, delete "case" and substitute -casing-;
In Claim 27, col. 20, line 61, delete "wherein"
In Claim 33, col. 21, line 36, delete "is";
In Claim 39, col. 22, line 12, delete "of" (first occurrence);
line 24, after the phrase "unit for the", insert the word -high-.

Signed and Sealed this

Twenty-first Day of September, 1999

*Attest:*

Q. TODD DICKINSON

*Attesting Officer*

*Acting Commissioner of Patents and Trademarks*